US008478156B2

(12) United States Patent
Shimoyama et al.

(10) Patent No.: US 8,478,156 B2
(45) Date of Patent: Jul. 2, 2013

(54) IMAGE FORMING APPARATUS HAVING AIR DUCT FACING FIXING MEMBER

(75) Inventors: Atsuhiko Shimoyama, Tahara (JP); Tooru Watanabe, Toyokawa (JP); Shigeru Tashiro, Toyokawa (JP); Noboru Oomoto, Toyokawa (JP); Yoshiyuki Toso, Toyokawa (JP); Tou Matsunaga, Okazaki (JP)

(73) Assignee: Konica Minolta Business Technologies, Inc, Chiyoda-Ku, Tokyo (JP)

( * ) Notice: Subject to any disclaimer, the term of this patent is extended or adjusted under 35 U.S.C. 154(b) by 240 days.

(21) Appl. No.: 13/034,888

(22) Filed: Feb. 25, 2011

(65) Prior Publication Data

US 2011/0211859 A1 Sep. 1, 2011

(30) Foreign Application Priority Data

Feb. 26, 2010 (JP) ..... 2010-042144

(51) Int. Cl.
*G03G 21/20* (2006.01)

(52) U.S. Cl.
USPC ..... 399/93

(58) Field of Classification Search
USPC ..... 399/92, 93, 320, 328, 335; 219/216
See application file for complete search history.

(56) References Cited

U.S. PATENT DOCUMENTS

| | | | | |
|---|---|---|---|---|
| 6,141,512 | A * | 10/2000 | Nagano et al. | 399/92 |
| 7,146,120 | B2 * | 12/2006 | Ogane et al. | 399/92 |
| 7,558,502 | B2 * | 7/2009 | Kanai | 399/92 |
| 7,973,291 | B2 | 7/2011 | Kagawa et al. | |

FOREIGN PATENT DOCUMENTS

| | | | |
|---|---|---|---|
| JP | 03139682 A | * | 6/1991 |
| JP | 03-220555 A | | 9/1991 |
| JP | 5-019582 A | | 1/1993 |
| JP | 06-059550 A | | 3/1994 |
| JP | 08101626 A | * | 4/1996 |
| JP | 09292804 A | * | 11/1997 |
| JP | 2003-140514 A | | 5/2003 |

(Continued)

OTHER PUBLICATIONS

Office Action (Preliminary Notice of Rejection) dated Jan. 17, 2012, issued in the corresponding Japanese Patent Application No. 2010-042144, and an English Translation thereof. (9 pages).

*Primary Examiner* — Robert Beatty
(74) *Attorney, Agent, or Firm* — Buchanan Ingersoll & Rooney PC

(57) ABSTRACT

An image forming apparatus includes a fixing member having a cylindrical or annular shape for fixing an image onto a sheet which is in pressure contact with an outer surface thereof; and a heating source for heating the fixing member to a fixing temperature. A duct is provided in a position facing the fixing member with respect to a width direction perpendicular to a circumferential direction of the fixing member and which has an inlet for taking in fine particles generated from the fixing member. An exhaust fan is provided inside the duct or in an outlet of the duct for generating an air flow going from the inlet to the outlet of the duct. A first filter member is provided upstream or downstream from the exhaust fan inside the duct and the first filter can trap the fine particles which flow through the duct getting on the air flow. A control section controls an amount of the air flow passing through the first filter member according to initial burst conditions under which the fine particles are emitted from the fixing member.

14 Claims, 13 Drawing Sheets

FOREIGN PATENT DOCUMENTS

| | | | | |
|---|---|---|---|---|
| JP | 2004053973 | A | * | 2/2004 |
| JP | 2005181870 | A | * | 7/2005 |
| JP | 2006215307 | A | * | 8/2006 |
| JP | 2007322753 | A | * | 12/2007 |
| JP | 2008-251514 | A | | 10/2008 |
| JP | 2009-031577 | A | | 2/2009 |

* cited by examiner

IMAGE FORMING APPARATUS HAVING AIR DUCT FACING FIXING MEMBER

This application is based on an application No. 2010-42144 filed in Japan on Feb. 26, 2010, the entire content of which is hereby incorporated by reference.

BACKGROUND ART

The present invention relates to an image forming apparatus, more particularly to an electrophotographic image forming apparatus such as printers, copying machines and facsimile machines.

It is known for this kind of an electrophotographic image forming apparatus that several kinds of chemical substances are emitted during imaging operation. Typical chemical substances to be emitted (chemical emission) include ozone generated during charging of a photoconductor and toner powder dust generated during developing or fixing operation. Conventional solutions to the chemical emission include taking measures against the emission source of such chemicals emission so as to decline the emission amount itself, and providing a filter to prevent emitted substances from being discharged to the outside of the apparatus. For example in JP 2003-140514 A, the filter is placed directly near a fixing roller of a fixing device so as to transmit the heat from the fixing roller to the filter for enhancing ozone removal capability of the filter.

However, with a recent increase in awareness of global environmental conservation, fine particles which are substances different from ozone or toner powder dust, particularly ultra fine particles (with a particle size of 100 nm or less) generated from electrophotographic image forming apparatuses have come to be seen as a problem. Up to now, it has been unknown where in the inside of an image forming apparatus the ultra fine particles are generated, and therefore it has been impossible to take effective measures for the problem.

As a result of the investigation conducted by the inventor of the present invention, it was found out that in an electrophotographic image forming apparatus, the ultra fine particles are mainly generated in a fixing device. Further, filter members such as electrostatic filters used for trapping the ultra fine particles are weak against heat.

As shown in FIG. 17A, a general fixing member 300 is composed of layers including a base material 301 made of a cylindrical core metal or an annular endless belt, a rubber layer 302 provided so as to cover the outer surface of the base material 301, and an outer layer 303 provided so as to cover the outer surface of the rubber layer 302. In this example, a heater 305 (equivalent to a heater 133 in FIG. 1) is provided in an internal space of the base material 301 for heating the fixing member 300 to a specified target temperature (a fixing temperature in the range of 180° C. to 200° C.). The rubber layer 302, which is made of a silicone rubber material, has heat tolerance to the fixing temperature and elasticity for allowing for the width of a nip section. The outer layer 303 is made of, for example, PFAs (tetra fluoro ethylene-PerFluoro Alkylvinyl ether copolymers) for aiding release of a sheet (recording material such as paper sheets) which passed the nip section. An end portion 302*e* of the rubber layer 302 and an end portion 303*e* of the outer layer 303 are positioned on the inside of an end portion 301*e* of the base material 301 respectively with respect to a direction along a central shaft C of the base material 301.

According to the investigation conducted by the inventor of the present invention, siloxane (designated by reference sign G) is generated in the form of ultra fine particles from the silicone rubber material which constitutes the rubber layer 302 when the base material 301, the rubber layer 302 and the like are heated with the heater 305 (reference sign H shows heat rays) as shown in FIG. 17B. Since the outer layer 303 made of PFAs and the like typically has a nature hard to transmit the ultra fine particles (gas barrier property), siloxane G is emitted from the end portion 302*e* of the rubber layer 302.

Examples of siloxanes include hexamethyldisiloxane (abbreviation: L2, molecular formula: $C_6H_{18}O_1Si_2$) hexamethylcyclotrisiloxane (abbreviation: D3, molecular formula: $C_6H_{18}O_3Si_3$), octamethyltrisiloxane (abbreviation: L3, molecular formula: $C_8H_{24}O_2Si_3$), octamethylcyclotetrasiloxane (abbreviation: D4, molecular formula: $C_8H_{24}O_4Si_4$), decamethyltetrasiloxane (abbreviation: L4, molecular formula: $C_{10}H_{30}O_3Si_4$) decamethylcyclopentasiloxane (abbreviation: D5, molecular formula: $C_{10}H_{30}O_8Si_8$), dodecamethylpentasiloxane (abbreviation: L5, molecular formula: $C_{12}H_{36}O_4Si_5$), and dodecamethylcyclohexasiloxane (abbreviation: D6, molecular formula: $C_{12}H_{36}O_8Si_6$).

An experiment conducted by the inventor of the present invention indicates that emission of siloxane G rapidly increases at the moment when the temperature of the fixing member 300 approximates 180° C. and the emission stops after the elapse of about 2 minutes. Such conditions for discharge of fine particles from the fixing member 300 (rubber layer 302 in particular) are called "initial burst conditions".

SUMMARY OF INVENTION

An image forming apparatus in one aspect of the invention comprises:

a fixing member having a cylindrical or annular shape for fixing an image onto a sheet which is in pressure contact with an outer surface thereof;

a heating source for heating the fixing member to a fixing temperature;

a duct which is provided in a position facing the fixing member with respect to a width direction perpendicular to a circumferential direction of the fixing member and which has an inlet for taking in fine particles generated from the fixing member;

an exhaust fan provided inside the duct or in an outlet of the duct for generating an air flow going from the inlet to the outlet of the duct;

a first filter member which is provided upstream or downstream from the exhaust fan inside the duct and which can trap the fine particles which flow through the duct getting on the air flow; and a control section for controlling an amount of the air flow passing through the first filter member according to initial burst conditions under which the fine particles are emitted from the fixing member.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DESCRIPTION OF EMBODIMENTS

Figure 1:
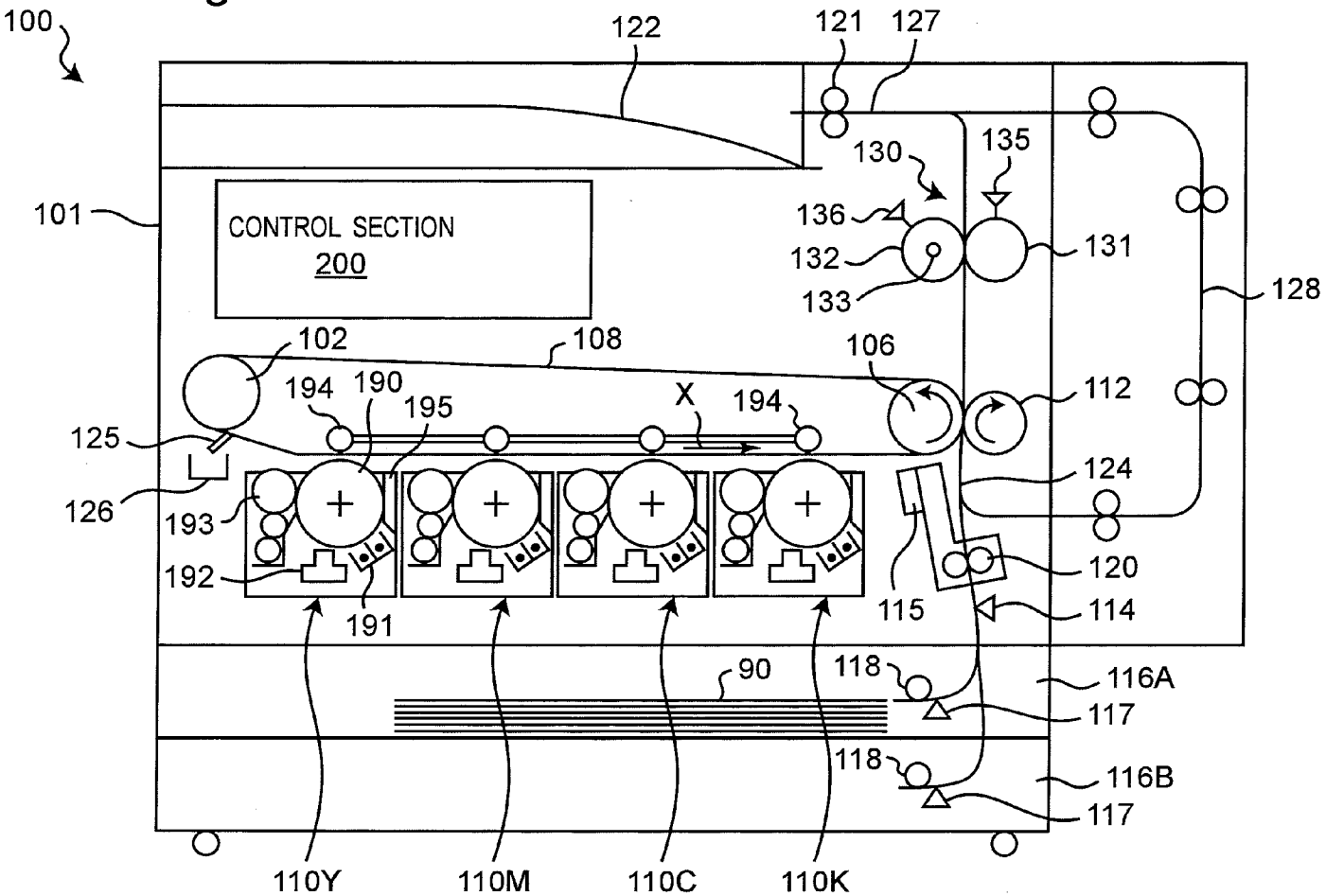
FIG. 1 is a view showing a cross sectional configuration of an image forming apparatus in one embodiment of the invention.

FIG. 1 shows a schematic configuration of a color tandem-type image forming apparatus 100 in one embodiment of the invention. The image forming apparatus 100, which is a multi-functional machine having functions of a scanner, a copier, a printer and other apparatuses, is called MFT (Multi Function Peripheral).

The image forming apparatus 100 includes an intermediate transfer belt 108 as an annular intermediate transfer body provided generally in the center inside a main body casing 101, the intermediate transfer belt 108 being wound around two rollers 102, 106 and moving in a circumferential direction. One roller 102 out of two rollers 102 and 106 is placed on the left-hand side in the drawing, while the other roller 106 is placed on the right-hand side in the drawing. The intermediate transfer belt 108 is supported on these rollers 102, 106 and is rotated in an arrow X direction.

Imaging units 110Y, 110M, 110C and 110K as printing sections corresponding to respective color toners of yellow (Y), magenta (M), cyan (C) and black (K) are placed below the intermediate transfer belt 108 side by side in order from the left-hand side in the drawing.

The respective imaging units 110Y, 110M, 110C and 110K have completely similar configuration except for a difference in toner color that the respective units handle. More specifically, the yellow imaging unit 110Y for example is integrally composed of a photoconductor drum 190, a charging device 191, an exposure device 192, a developing device 193 for performing development with use of toner, and a cleaner device 195. A primary transfer roller 194 is provided in a position facing the photoconductor drum 190 across the intermediate transfer belt 108.

At the time of image formation, the surface of the photoconductor drum 190 is first uniformly charged with the charging device 191, and then the surface of the photoconductor drum 190 is exposed with the exposure device 192 in response to an image signal inputted from an unshown external unit to form a latent image thereon. Next, the latent image on the surface of the photoconductor drum 190 is developed into a toner image with the developing device 193. This toner image is transferred onto the intermediate transfer belt 108 upon voltage application to between the photoconductor drum 190 and the primary transfer roller 194. The transfer residual toner on the surface of the photoconductor drum 190 is cleaned with the cleaner device 195.

As the intermediate transfer belt 108 moves in the arrow X direction, overlapped toner images of four colors are formed as inputted images on the intermediate transfer belt 108 with each of the imaging units 110Y, 110M, 110C and 110K.

Provided on the left-hand side of the intermediate transfer belt 108 are a cleaning device 125 for removing residual toner from the surface of the intermediate transfer belt 108 and a toner collecting box 126 for collecting the toner removed with the cleaning device 125. A secondary transfer roller 112 as a secondary transfer member is provided on the right-hand side of the intermediate transfer belt 108 across a conveying path 124 for paper sheets. A conveying roller 120 is provided at a position corresponding to the upstream of the secondary transfer roller 112 on the conveying path 124. An optical concentration sensor 115 is provided as a toner concentration sensor for detecting toner patterns on the intermediate transfer belt 108.

A fixing device 130 is provided on the upper right part inside the main body casing 101 as a fixing section for fixing toner onto paper sheets. The fixing device 130 includes a heating roller 132 as a fixing member extending perpendicularly to the page of FIG. 1 and a pressure roller 131 as a pressure member. The heating roller 132 is heated to a specified target temperature (a fixing temperature in the range of 180° C. to 200° C. in this example) with a heater 133 as a heating source. The pressure roller 131 is biased toward the heating roller 132 with an unshown spring. Accordingly, the pressure roller 131 and the heating roller 132 form a nip section for fixation. As a paper sheet 90 carrying a toner image transferred thereon passes through the nip section, the toner image is fixed onto the paper sheet 90.

Paper cassettes 116A, 116B as paper feed ports for storing paper sheets 90 as printing media, on which output images should be formed, are provided in two levels in the lower part of the main body casing 101. The paper cassettes 116A, 116B are respectively equipped with a feed roller 118 for sending out paper sheets and a feeding sensor 117 for sensing the sent-out paper sheets. For the sake of simplicity, the drawing shows the state in which the paper sheets 90 are stored only in the paper cassette 116A.

A control section 200 for controlling the operation of the entire image forming apparatus is provided in the main body casing 101.

Figure 3:
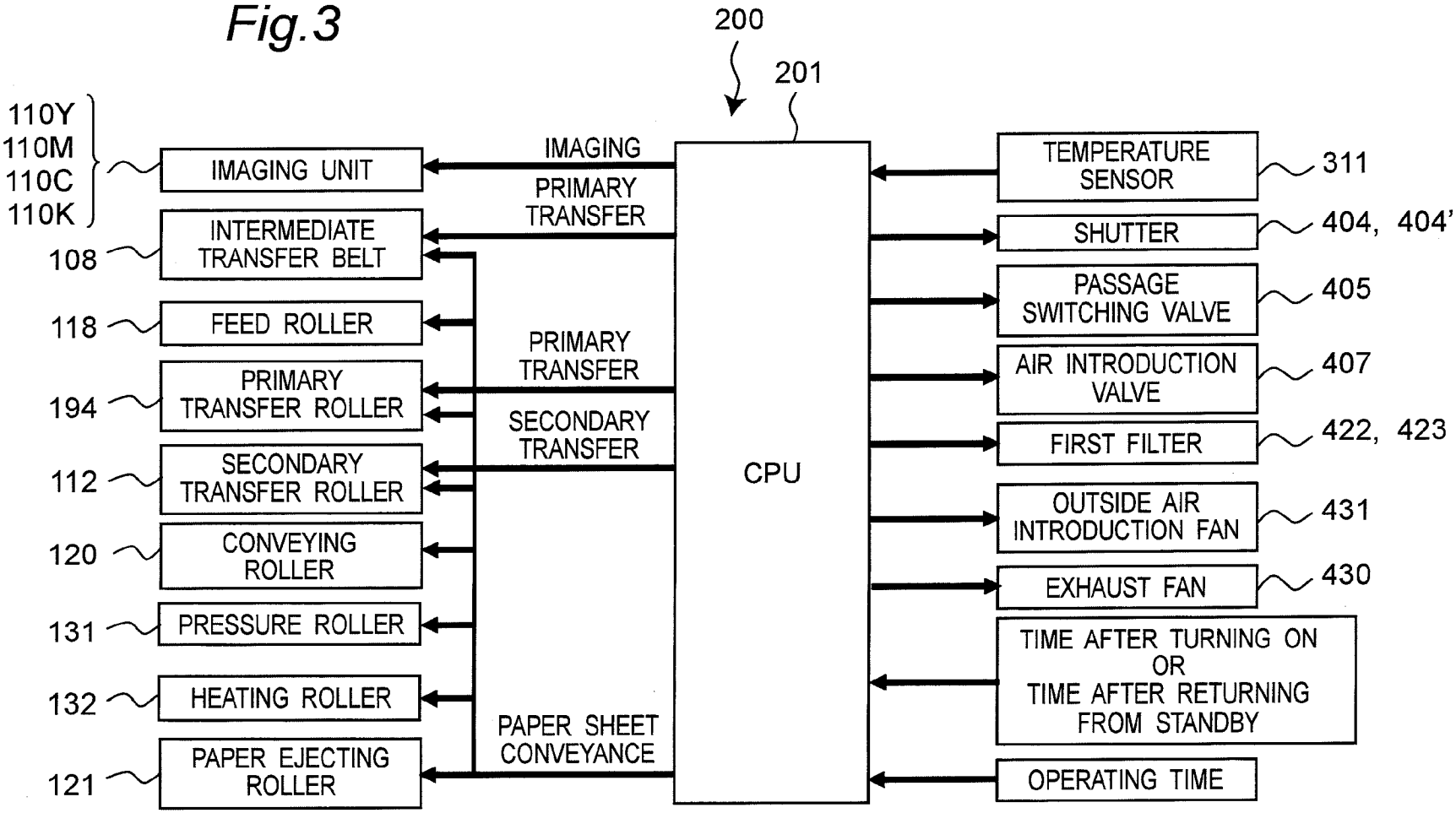
FIG. 3 is a control block diagram of a principal part of the image forming apparatus.

As shown in FIG. 3, the control section 200 is constituted of a CPU (Central Processing Unit) 201 to control, in this example, the respective imaging units 110Y, 110M, 110C and 110K, the intermediate transfer belt 108, the feed roller 118, the primary transfer roller 194, the secondary transfer roller 112, the conveying roller 120, the pressure roller 131, the heating roller 132, and a paper ejecting roller 121. The control section 200 also controls a later-described temperature sensor 311, shutters 404, 404', a passage switching valve 405, an outside air introduction valve 407, first filter members 422, 423, an exhaust fan 430 and an outside air introduction fan 431.

At the time of image formation, paper sheets 90 shown in FIG. 1 are sent out one by one with the feed roller 118 from, for example, the paper cassette 116A to the conveying path 124 under control by the control section 200. The paper sheets 90 sent out to the conveying path 124 are sent into a toner transfer position between the intermediate transfer belt 108 and the secondary transfer roller 112 by the conveying roller 120 with the timing decided by a resist sensor 114. Meanwhile, an overlapped toner image of four colors is formed on the intermediate transfer belt 108 with the respective imaging units 110Y, 110M, 110C and 110K as mentioned before. The toner image of four colors on the intermediate transfer belt 108 is transferred onto a paper sheet 90, which was sent into the toner transfer position, with the secondary transfer roller 112. The paper sheet 90 with the toner image transferred thereon is heated and pressed while passing through the nip section formed between the pressure roller 131 and the heating roller 132 of the fixing device 130. As a result, the toner image is fixed onto the paper sheet 90. The paper sheet 90 with the toner image fixed thereto is then discharged with the paper ejecting roller 121 into a paper ejection tray section 122 provided on the upper surface of the main body casing 101 through a paper ejecting path 127. In this example, a switchback conveying path 128 is provided for resending paper sheets 90 into the toner transfer position in the case of double-side printing.

Figure 2:
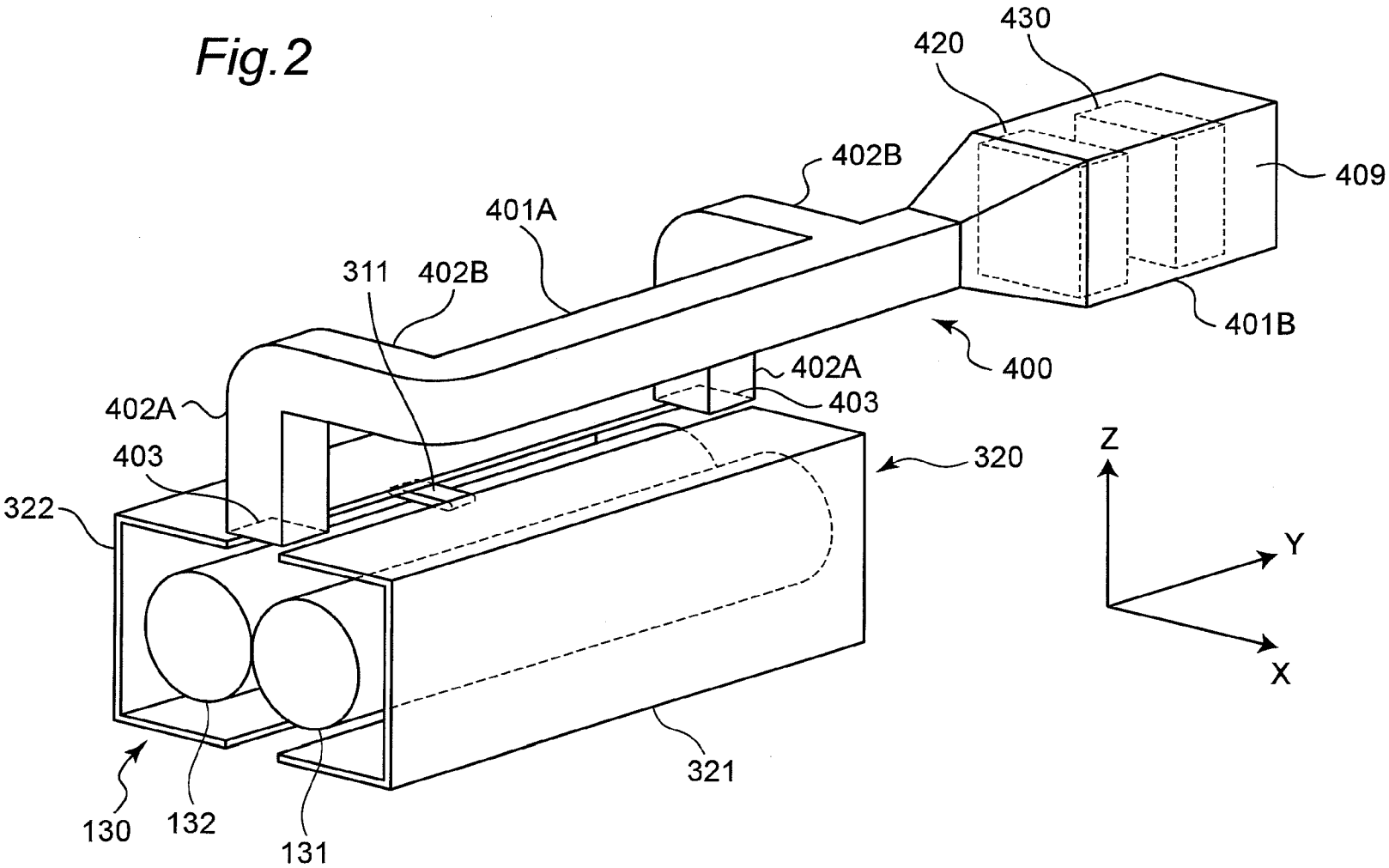
FIG. 2 is a view showing a configuration in the vicinity of a fixing device of the image forming apparatus.

FIG. 2 shows the vicinity of the fixing device 130 included in the image forming apparatus 100 as viewed in an oblique direction.

Figure 17A:
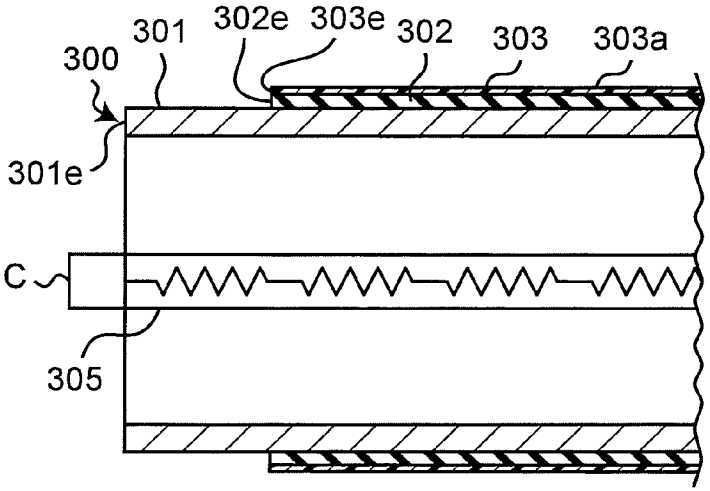
Fig.17A RELATED ART
FIG. 17A is a cross sectional view showing a general configuration of a heating roller.
Figure 17B:
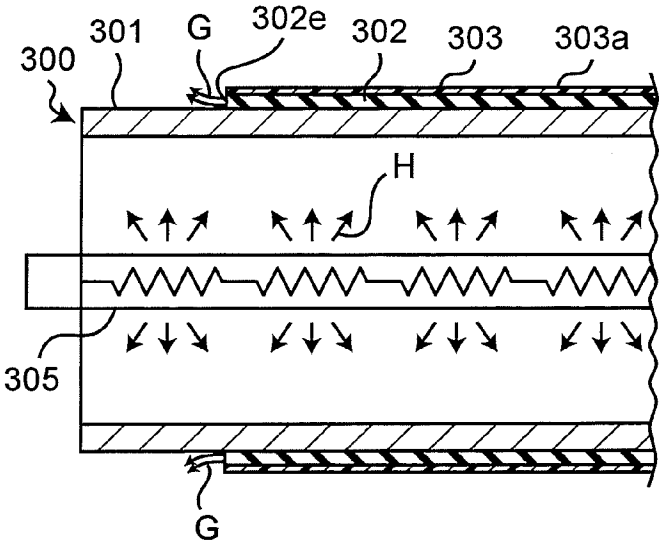
Fig.17B RELATED ART
FIG. 17B is a view showing the state of siloxane as ultra fine particles being emitted from an end portion of a rubber layer in the heating roller.

In a configuration example of the fixing device 130, the heating roller 132 and the pressure roller 131 of the fixing device 130 are composed of layers including a base material (core metal), a rubber layer and an outer layer in completely the same manner as the fixing member 300 shown in FIG. 17A. In FIG. 2, the heating roller 132, which is supported onto the main body casing 101 via an unshown frame, is rotated in a counterclockwise direction around its central axis with an unshown drive motor. The pressure roller 131 rotates in a clockwise direction with the rotation of the heating roller 132. A temperature sensor 311 constituted of a thermistor for measuring the temperature of the heating roller 132 is provided above the heating roller 132 at a central position with respect to an axial direction (direction Y) of the heating roller 132 so as to be in contact with the heating roller 132.

The fixing device 130 has a casing 320 supported and fixed onto the main body casing 101 via an unshown frame. The casing 320 has a first casing 321 for covering the pressure roller 131 and a second casing 322 for covering the heating roller 132. Each of the first casing 321 and the second casing 322 has a squared U-shaped cross section with their openings facing each other across a clearance, through which the paper sheets 90 travel.

In this embodiment, a duct 400 supported and fixed onto the main body casing 101 via an unshown frame is provided in the vicinity of the fixing device 130. The duct 400 may be made of any one of resin materials having heat tolerance to the fixing temperature or metallic materials such as aluminum and iron.

The duct 400 has a pair of inlets 403, 403 provided in a clearance between the first casing 321 and the second casing 322 at positions corresponding to both the ends of the heating roller 132 with respect to the axial direction (direction Y) of the heating roller 132. The duct 400 is further composed of a pair of vertical sections 402A, 402A each extending upward in a vertical direction (direction Z) from the inlets 403, 403, a pair of first horizontal sections 402B, 402B each curved from the upper part of these vertical sections 402A, 402A and extending in a horizontal direction (direction X), a second horizontal section 401A joining with these first horizontal sections 402B, 402B and extending in the direction Y, and an expanded section 401B continuing to the downstream of the second horizontal section 401A and having a cross section larger than the cross section of the second horizontal section 401A. A downstream end section of the expanded section 401B constitutes an outlet 409 of the duct 400. The outlet 409 of the duct 400 is opened toward the outside or the inside of the main body casing 101.

Inside the expanded section 401B, the exhaust fan 430 is provided in the vicinity of the outlet 409. The exhaust fan 430 generates an air flow going from a pair of the inlets 403, 403 to the outlet 409 of the duct 400. Also inside the expanded section 401B, a first filter member 420 is provided upstream from the exhaust fan 430 with respect to the air flow.

As the first filter member 420, commercial items such as Elitolon (registered trademark of Toyobo Co., Ltd.) that is an electrostatic filter made by Toyobo Co., Ltd., andmicronAir (registered trademark of Freudenberg & Co.) made by Freudenberg & Co. Kommanditgesellschaft are used so that ultra fine particles, particularly siloxane, generated from the rubber layer can be trapped. Filtering media having carbon or PTFE (polytetrafluoroethylene) as a main component may be used from a viewpoint of securing the heat tolerance of the filter member.

First Embodiment

Figure 4A:
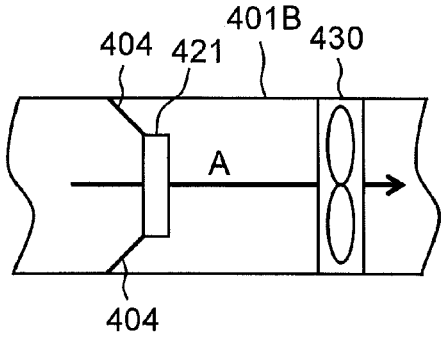
FIGS. 4A and 4B are detail views showing configuration and operation inside a duct of the image forming apparatus, respectively.

FIG. 4A shows a configuration inside the expanded section 401B of the image forming apparatus 100, and more specifically shows a cross sectional configuration of the first filter member in one aspect (denoted by reference sign 421) and the expanded section 401B in the vicinity thereof. The first filter member 421 is provided so as to be fixed to a sectional central section of the expanded section 401B with its posture perpendicular to the direction of an air flow A inside the expanded section 401B. The size of the cross section of the first filter member 421 is smaller than the size of the cross section of the expanded section 401B at a position where the first filter member 421 is provided.

Figure 4B:
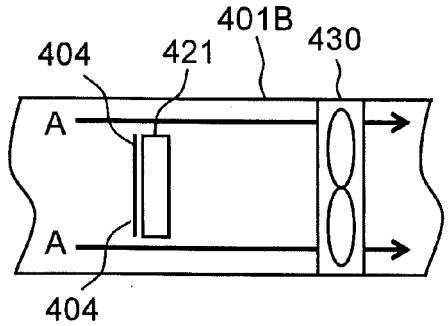

As shown in FIG. 4A, a shutter 404 is provided, in this example, rotatably around an unshown hinge between the shutter 404 and the first filter member 421 so as to close the clearance between the first filter member 421 and the expanded section 401B. Accordingly, in the state shown in FIG. 4A, the clearance is closed so that all the air flow (shown with an arrow A as in the following FIG. 4A to FIG. 8B) generated with the exhaust fan 430 passes through the first filter member 421. This state is defined as a first state. On the other hand, in the state shown in FIG. 4B, one side of the first filter member 421 is totally covered with the shutter 404. Consequently, the air flow A avoids the first filter member 421 due to the presence of the shutter 404. This state is defined as a second state. The shutter 404 is provided so as to be able to switch between the first state and the second state with an unshown shutter switching mechanism. The shutter 404 is also controlled by a control section 200.

Figure 12A:
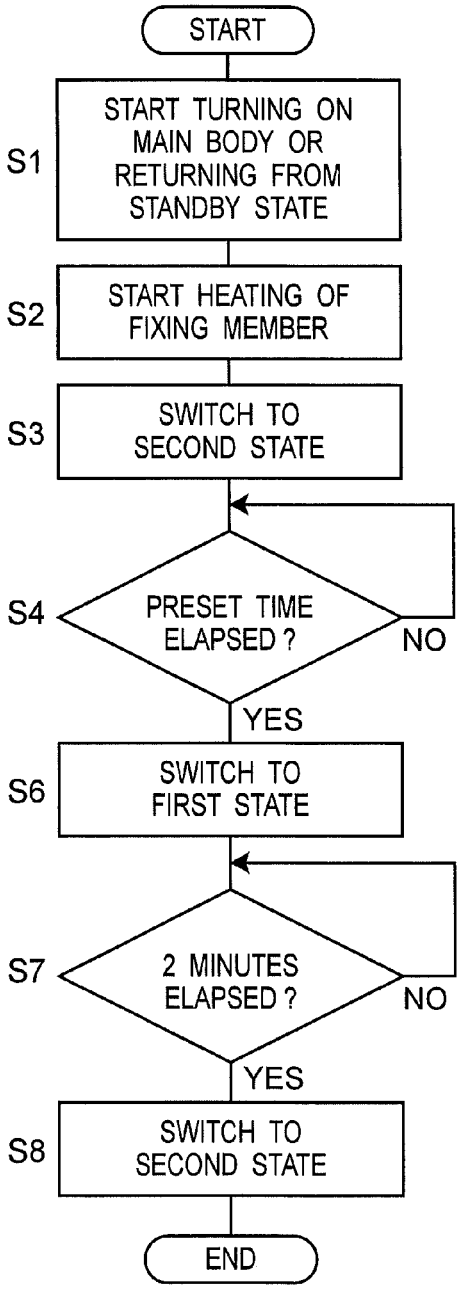
FIGS. 12A and 12B are flow charts for control of a switching mechanism of the duct by a control section of the image forming apparatus, respectively.

FIG. 12A shows a flow chart for control of the shutter 404 by the control section 200 of the image forming apparatus 100. Description is now given of the operation of the shutter 404 with reference to FIG. 4A, FIG. 4B and FIG. 12A.

(i) In this example, the image forming apparatus 100 is first turned on or returned from a standby state (Step S1 in FIG. 12A), and then the heating roller 132 is heated with the heater 133 (Step S2 in FIG. 12A). Then, the control section 200 controls the shutter 404 so as to switch to the second state (Step S3 in FIG. 12A, FIG. 4B). Next, the control section 200 determines whether or not a preset time as a period of time until the start of emission of ultra fine particles has elapsed (Step S4 in FIG. 12A). More specifically, the control section 200 determines whether or not 30 seconds, that is a preset first standby time, has elapsed after the start of heating of the heating roller 132 upon turning on the image forming apparatus 100, or determines whether or not 20 seconds, that is a preset first standby time, has elapsed after the start of heating of the heating roller 132 upon returning from the standby state of the image forming apparatus 100. If the control section 200 determines that the preset time has not yet elapsed ("NO" in Step S4 in FIG. 12A), then it determines whether or not the preset time has elapsed again (Step S4 in FIG. 12A). Accordingly, the air flow A heated with the heating roller 132 will not pass through the first filter member 421 until the preset time elapses after the start of heating of the heating roller 132. Since the control section 200 controls the shutter 404 based on the time, the shutter 404 can be controlled with simple configuration as compared with the case of using sensors and the like. Therefore, an influence of heat upon the first filter member 421 by the air flow A can be suppressed with simple configuration.

(ii) On the other hand, if the control section 200 determines that the preset time has elapsed ("YES" in Step S4 in FIG. 12A), then it controls the shutter 404 so as to switch to the first state (Step S6 in FIG. 12A, FIG. 4A).

(iii) Next, the control section 200 determines whether or not 2 minutes, that is a preset first operating time as a period of time from the time when the emission of ultra fine particles is rapidly increased to the time when the emission is settled down after the first standby time, has elapsed (Step S7 in FIG. 12A). The period of time of "2 minutes" is one of the aforementioned initial burst conditions. If the control section 200 determines that 2 minutes has not yet elapsed ("NO" in Step S7 in FIG. 12A), then it determines whether or not 2 minutes has elapsed again (Step S7 in FIG. 12A). If the control section 200 determines that 2 minutes has elapsed ("YES" in Step S7 in FIG. 12A), then it controls the shutter 404 so as to switch to the second state (Step S8 in FIG. 12A, FIG. 4B). Accordingly, since the air flow A heated with the heating roller 132 does not pass through the first filter member 421 except for the 2 minutes that is one of the initial burst conditions, an influence of heat upon the first filter member 421 can reliably be suppressed as compared with the case when the air flow A constantly passes through the first filter member 421. Furthermore, since the air flow A containing a large number of ultra fine particles passes through the first filter member 421 only for the 2 minutes while the initial burst is happening, the ultra fine particles can efficiently be trapped as compared with the case when the air flow A constantly passes through the first filter member 421. Further, since the first filter member 421 is an electrostatic filter, the ultra fine particles can more efficiently be trapped due to Coulomb force.

As described in (i) to (iii), the control section 200 determines whether or not the preset time has elapsed, i.e., determines whether or not initial burst conditions are fulfilled, then it controls the shutter 404 so as to switch to the first state or to the second state. Consequently, it becomes possible to efficiently trap the ultra fine particles and to suppress an influence of heat upon the first filter member 421. Therefore, according to the image forming apparatus 100, it becomes possible to prevent diffusion of the ultra fine particles to the environment inside and around the apparatus and to lengthen the life span of the first filter member 421.

Figure 12B:
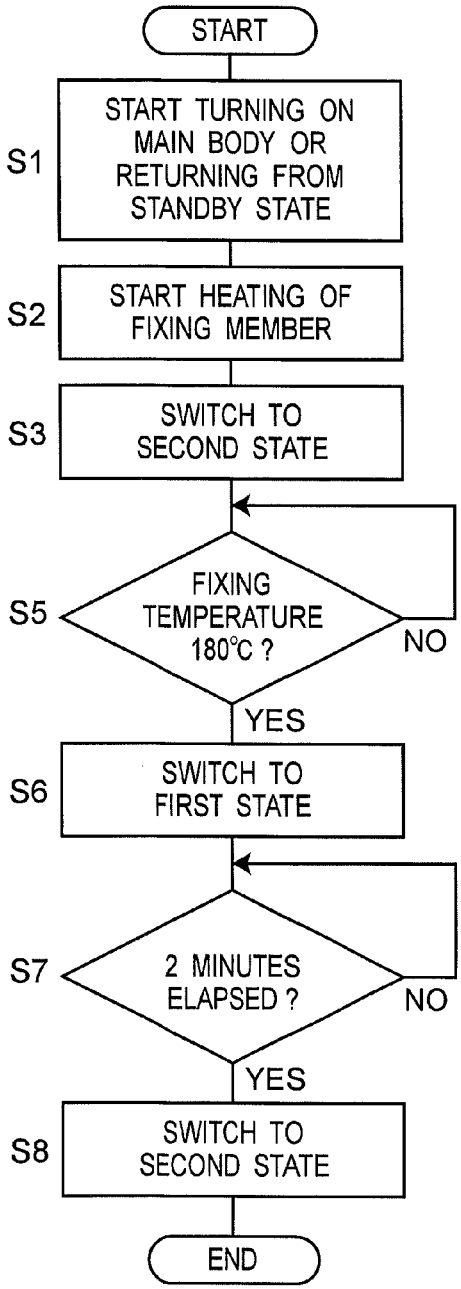

The control section 200 may control the shutter 404 according to the control shown in the flow chart for control in FIG. 12B in place of the flow chart in FIG. 12A. It is to be noted that in the flow chart of FIG. 12B, the steps identical to those in the flow chart of FIG. 12A are designated by identical step number to omit detailed explanation.

(i') As shown in FIG. 12B, in place of Step S4 of FIG. 12A, the initial burst conditions are determined based on a fixing temperature. In this case, the control section 200 determines whether or not the fixing temperature of the heating roller 132 measured with the temperature sensor 311 has reached 180° C., that is a first threshold temperature (Step S5 in FIG. 12B). The temperature of "180° C.", which is the temperature at which emission of the ultra fine particles can be regarded to increase rapidly, is one of the aforementioned initial burst conditions. If the control section 200 determines that the fixing temperature has not yet reached 180° C. ("NO" in Step S5 in FIG. 12B), it determines whether or not the fixing temperature has reached 180° C. again (Step S5 in FIG. 12B). Accordingly, the air flow A heated with the heating roller 132 will not pass through the first filter member 421 until the temperature of the heating roller 132 measured with the temperature sensor 311 has reached 180° C. that is one of the initial burst conditions. Since the control section 200 controls the shutter 404 based on the temperature, heat can be controlled more precisely as compared with the case when the control section 200 controls the shutter 404 based on the time. Therefore, as compared with the case when the air flow A constantly passes through the first filter member 421, the ultra fine particles can efficiently be trapped and an influence of heat upon the first filter member 421 by the air flow A can reliably be suppressed.

(ii') On the other hand, if the control section 200 determines that the fixing temperature has reached 180° C. ("YES" in Step S5 in FIG. 12B), then it controls the shutter 404 so as to switch to the first state (Step S6 in FIG. 12B, FIG. 4A).

(iii') Next, the control section 200 determines whether or not 2 minutes, that is the preset second operating time as a period of time from the time when the emission of ultra fine particles is rapidly increased to the time when the emission is settled down, after attaining to the first threshold temperature, has elapsed (Step S7 in FIG.

12B). As the process thereafter is similar to that in the flow chart flow chart of FIG. 12A, detailed explanation thereof will be omitted.

As described in (i') to (iii'), the control section 200 determines whether or not the fixing temperature of the heating roller 132 measured with the temperature sensor 311 has reached 180° C., i.e., determines whether or not the initial burst conditions are fulfilled, based on which the shutter 404 is controlled so as to switch to the first state or to the second state. Accordingly, it becomes possible to efficiently trap the ultra fine particles and to suppress an influence of heat upon the first filter member 421. Therefore, according to the image forming apparatus 100, it becomes possible to prevent diffusion of the ultra fine particles to the environment inside and around the apparatus and to lengthen the life span of the first filter member 421.

In either case of FIG. 12A and FIG. 12B, the control section 200 controls the shutter 404 so as to switch between the first state in which the air flow A heated with the heating roller 132 passes through the first filter member 421 and the second state in which the shutter 404 covers the entire surface of the first filter member 421 so that the air flow A avoids the first filter member 421. Therefore, since the air flow A avoids the first filter member 421 in the second state, an influence of heat upon the first filter member 421 by the air flow A can reliably be suppressed as compared with the case when the air flow A constantly passes through the first filter member 421.

Second Embodiment

Figure 5A:
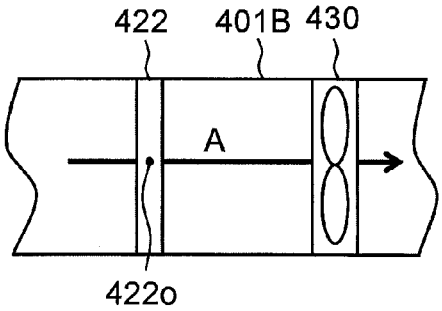
FIGS. 5A and 5B are detail views showing configuration and operation inside a duct of the image forming apparatus, respectively.

FIG. 5A shows a configuration inside the expanded section 401B of the image forming apparatus 100, and more specifically shows a cross sectional configuration of the first filter member in one aspect (denoted by reference sign 422) and the expanded section 401B in the vicinity thereof. It is to be noted that in the second embodiment, component members identical to those in the first embodiment are designated by identical reference signs to omit explanation.

As shown in FIG. 5A, the first filter member 422 is provided, in this example, rotatably around a axis 422*o* passing through the center of the expanded section 401B (and the first filter member 422) perpendicularly to the page of FIG. 5A so as to be able to close a clearance between the first filter member 421 and the expanded section 401B. The size of the cross section of the first filter member 422 is equal to the size of the cross section of the expanded section 401B at a position where the first filter member 422 is provided. As a result, in the state of FIG. 5A, i.e., in the state where the first filter member 422 is perpendicular to the direction of an air flow A, the clearance is closed so that the air flow A generated with the exhaust fan 430 all passes through the first filter member 422. This state is defined as a first state. On the other hand, in the state shown in FIG. 5B, the first filter member 422 is parallel to the direction of the air flow A. Accordingly, the air flow A avoids the first filter member 422. This state is defined as a second state. The first filter member 422 is provided so as to be able to switch between the first state and the second state with an unshown first filter member switching mechanism. The first filter member 422 is also controlled by the control section 200.

Figure 5B:
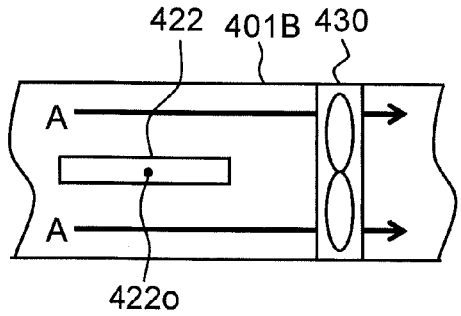

Description is now given of the operation of the first filter member 422 with reference to FIG. 5A, FIG. 5B and FIG. 12A.

In this example, after processing of Steps S1 and S2 in FIG. 12A, the control section 200 controls the first filter member 422 so as to switch to the second state (Step S3 in FIG. 12A, FIG. 5B). Next, after processing of Step S4 in FIG. 12A, the control section 200 controls the first filter member 422 so as to switch to the first state (Step S6 in FIG. 12A, FIG. 5A). Then, after processing of Step S7 in FIG. 12A, the control section 200 controls the first filter member 422 so as to switch to the second state (Step S8 in FIG. 12A, FIG. 5B).

In the image forming apparatus 100 having the first filter member 422, the first filter member 422 does not have a shutter 404, and the control section 200 controls the first filter member 422 itself to switch between the first state and the second state, so that the first filter member 422 can be controlled with simple configuration as compared with the case where the first filter member 420 has the shutter 404. Therefore, an influence of heat upon the first filter member 422 by the air flow A can be suppressed with simple configuration.

It is to be noted that the control section 200 may control the first filter member 422 based on the control shown in the flow chart flow chart for control in FIG. 12B.

Third Embodiment

Figure 6A:
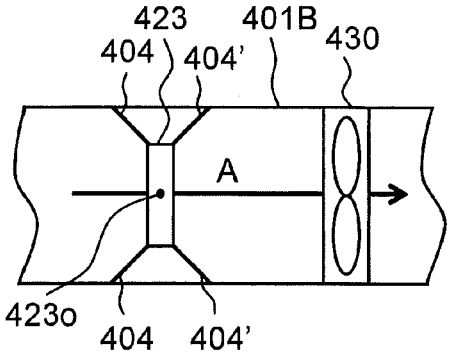
FIGS. 6A and 6B are detail views showing configuration and operation inside a duct of the image forming apparatus, respectively.

FIG. 6A shows a configuration inside the expanded section 401B of the image forming apparatus 100, and more specifically shows a cross sectional configuration of the first filter member in one aspect (denoted by reference sign 423) and the expanded section 401B in the vicinity thereof. It is to be noted that in the third embodiment, component members identical to those in the first embodiment are designated by identical reference signs to omit explanation.

As shown in FIG. 6A, the first filter member 423 is provided rotatably around a axis 423*o* passing through the center of the expanded section 401B (and the first filter member 423) perpendicularly to the page of FIG. 6A. Shutters 404, 404' are each provided along the upstream and downstream of the first filter member 423 with respect to an air flow A. The shutters 404, 404' are respectively provided, in this example, rotatably around an unshown hinge between these shutters 404, 404' and the first filter member 423 so as to be able to close a clearance between the expanded section 401B and the first filter member 423. Accordingly, in the state of FIG. 6A, i.e., in the state where the first filter member 423 is perpendicular to the direction of the air flow A, the clearance is closed so that the air flow A generated with the exhaust fan 430 all passes through the first filter member 423. This state is defined as a first state. On the other hand, in the state shown in FIG. 6B, the first filter member 423 is parallel to the direction of the air flow A. Both the sides of the first filter member 423 are covered with the shutters 404, 404'. Consequently, the air flow A avoids the first filter member 423. This state is defined as a second state. The first filter member 423 is provided so as to be able to switch between the first state and the second state with an unshown first filter member switching mechanism. The first filter member 423 is also controlled by the control section 200. The shutters 404, 404' are provided so as to be able to switch between the first state and the second state with an unshown shutter switching mechanism. The shutters 404, 404' are also controlled by the control section 200.

Figure 6B:
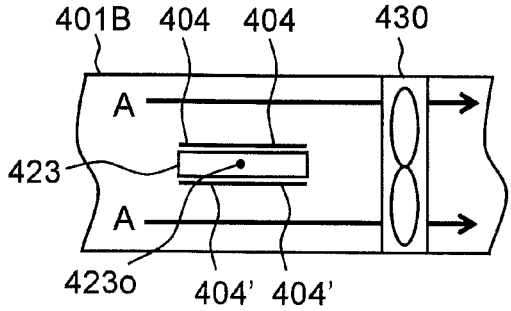

Description is now given of the operation of the first filter member 423 as well as the shutters 404, 404' with reference to FIG. 6A, FIG. 6B and FIG. 12A.

In this example, after processing of Steps S1 and S2 in FIG. 12A, the control section 200 controls the first filter member 423 and the shutters 404, 404' so as to switch to the second state (Step S3 in FIG. 12A, FIG. 6B). Next, after processing of Step S4 in FIG. 12A, the control section 200 controls the first filter member 423 and the shutters 404, 404' so as to switch to the first state (Step S6 in FIG. 12A, FIG. 6A). Then, after processing of Step S7 in FIG. 12A, the control section 200 controls the first filter member 423 and the shutters 404, 404' so as to switch to the second state (Step S8 in FIG. 12A, FIG. 6B).

In the image forming apparatus 100 having the first filter member 423, the first filter member 423 is generally parallel to the direction that the air flow A flows, and both the sides of the first filter member 423 are covered with the shutters 404, 404'. Accordingly, as compared with the case were the first filter member 421 has a shutter 404 only in the upstream of the air flow A and the case where the first filter member 422 is generally parallel to the direction that the air flow A flows, it becomes possible to more reliably prevent the air flow A from passing through the first filter member 423. Therefore, an influence of heat upon the first filter member 423 by the air flow can be more reliably suppressed.

It is to be noted that the control section 200 may control the first filter member 423 and the shutters 404, 404' based on the control shown in the flow chart flow chart for control in FIG. 12B.

Fourth Embodiment

Figure 7A:
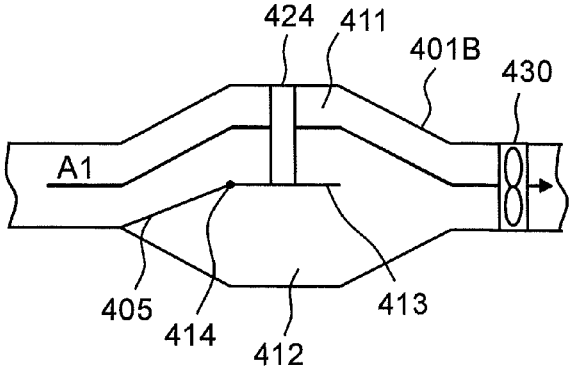
FIGS. 7A and 7B are detail views showing configuration and operation inside a duct of the image forming apparatus, respectively.

FIG. 7A shows a configuration inside the expanded section 401B of the image forming apparatus 100, and more specifically shows a cross sectional configuration of the expanded section 401B. It is to be noted that in the fourth embodiment, component members identical to those in the first embodiment are designated by identical reference signs to omit explanation.

As shown in FIG. 7A, the expanded section 401B has a first path 411 and a second path 412 parallel to the first path 411 formed by a divider plate 413. A passage switching valve 405 is provided on the upstream of the first path 411 and the second path 412. The passage switching valve 405 is provided, in this example, rotatably around a axis 414 which is provided in the expanded section 401B and which is perpendicular to the page of FIG. 7A. A first filter member 424 is fixedly provided in the first path 411 so as to block the first path 411. The size of the cross section of the first filter member 424 is equal to the size of the cross section of the first path 411 at a position where the first filter member 424 is provided. Accordingly, in the state shown in FIG. 7A, i.e., in the state where the second path 412 is closed and the first path 411 is switched with the passage switching valve 405, an air flow A1 generated with the exhaust fan 430 all goes through the first path 411 and passes through the first filter member 424. This state is defined as a first state. In the state shown in FIG. 7B, i.e., in the state where the first path 411 is closed and the second path 412 is switched with the passage switching valve 405, an air flow A2 generated with the exhaust fan 430 all goes through the second path 412 and avoids the first filter member 424. This state is defined as a second state. The passage switching valve 405 is provided so as to be able to switch between the first path 411 and the second path 412 with an unshown passage switching mechanism. The passage switching valve 405 is also controlled by the control section 200.

Figure 13A:
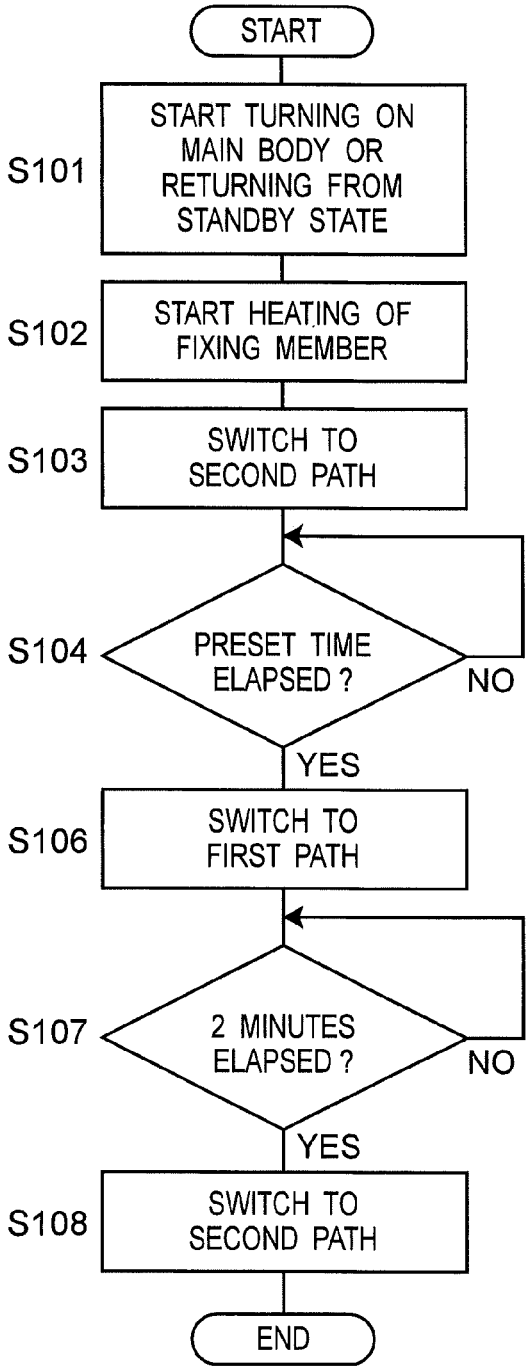
FIGS. 13A and 13B are flow charts for control of a switching mechanism of the duct by a control section of the image forming apparatus, respectively.

FIG. 13A shows a flow chart flow chart for control of the passage switching valve 405 by the control section 200 of the image forming apparatus 100. Description is now given of the operation of the passage switching valve 405 with reference to FIG. 7A, FIG. 7B and FIG. 13A.

Figure 7B:
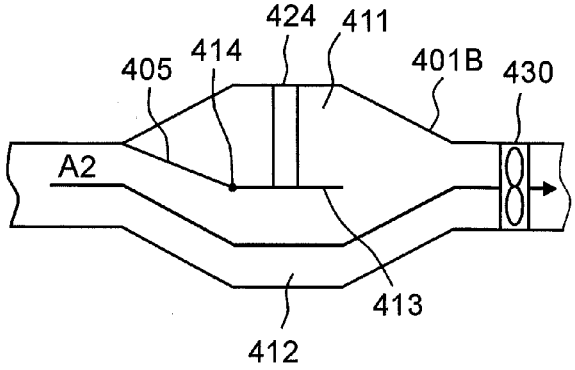

In this example, after processing of Steps S101 and S102 in FIG. 13A (similar to the processing of Steps S1 and S2 in FIG. 12A), the control section 200 controls the passage switching valve 405 so as to switch to the second path 412 (Step S103 in FIG. 13A, FIG. 7B). Next, after processing of Step S104 in FIG. 13A (similar to the processing of Step S4 in FIG. 12A), the control section 200 controls the passage switching valve 405 so as to switch to the first path 411 (Step S106 in FIG. 13A, FIG. 7A). Then, after processing of Step S107 in FIG. 13A (similar to the processing of Step S7 in FIG. 12A), the control section 200 controls the passage switching valve 405 so as to switch to the second path 412 (Step S108 in FIG. 13A, FIG. 7B).

Figure 13B:
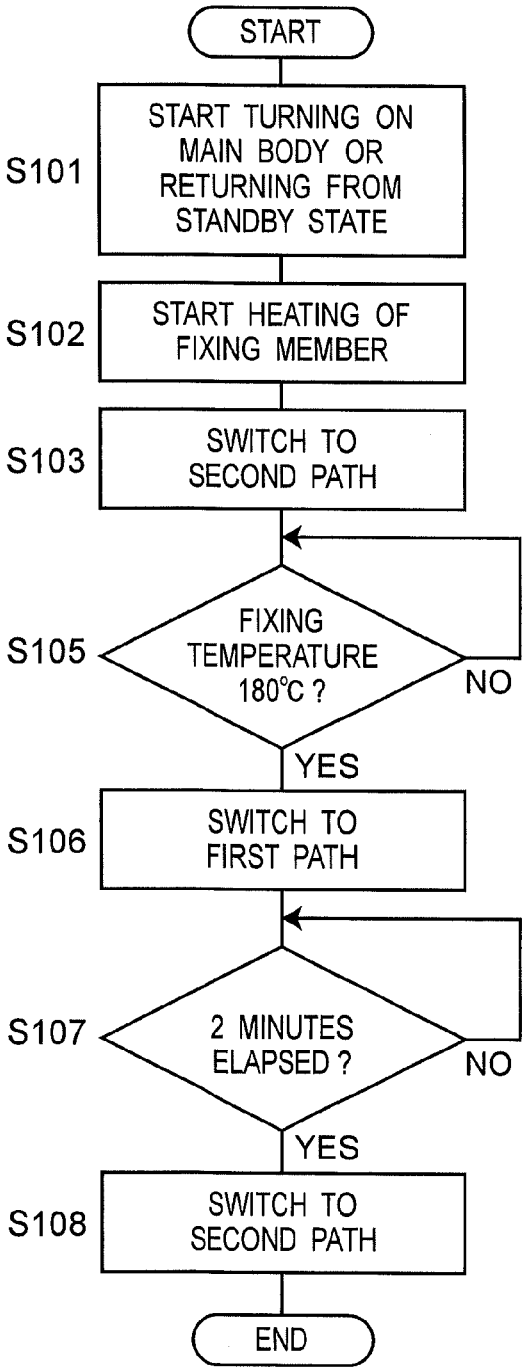

The control section 200 may control the passage switching valve 405 based on the control shown in the flow chart flow chart for control in FIG. 13B. It is to be noted that in the flow chart flow chart of FIG. 13B, the steps identical to those in the flow chart flow chart of FIG. 13A are designated by identical step number to omit detailed explanation. As shown in FIG. 13B, the processing of Step S104 in FIG. 13A is replaced with the processing of Step S105 in FIG. 13B, i.e., initial burst conditions are determined based on the fixing temperature (similar to the processing of Step S5 in FIG. 12B).

In the image forming apparatus 100 having the passage switching valve 405, an influence of heat upon the first filter member 424 by the air flow A1 can more reliably be suppressed as in the first embodiment. Moreover, in the second state, the air flow A2 all passes the second path 412. In this case, there is nothing that blocks the air flow A2 in the second path 412. Therefore, in the second state, the air flow A2 can smoothly pass the duct 400.

Fifth Embodiment

Figure 8A:
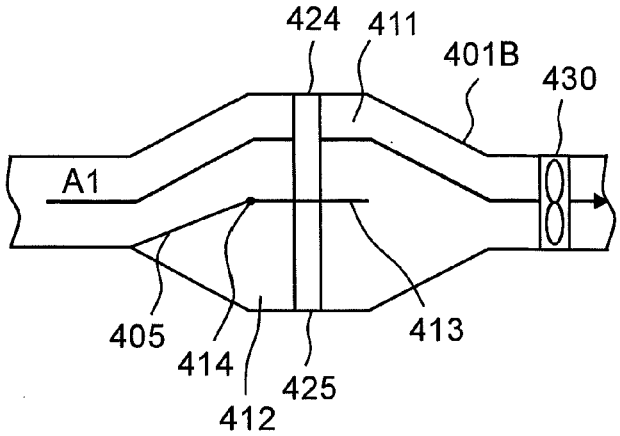
FIGS. 8A and 8B are detail views showing configuration and operation inside a duct of the image forming apparatus, respectively.
Figure 8B:
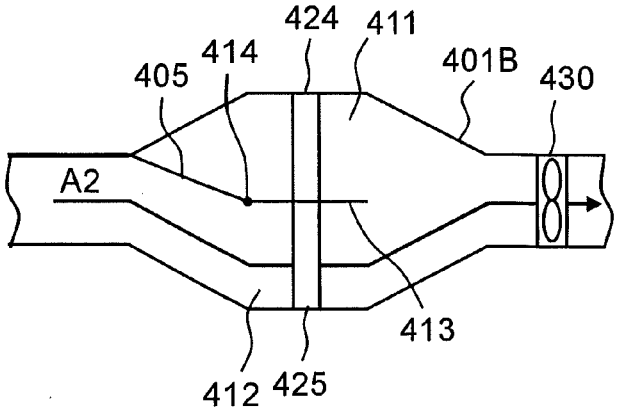

FIG. 8A shows a configuration inside the expanded section 401B of the image forming apparatus 100, and more specifically shows a cross sectional configuration of the expanded section 401B. It is to be noted that in the fifth embodiment, component members identical to those in the fourth embodiment are designated by identical reference signs to omit explanation.

Description is now given of the component members in the fifth embodiment different from those in the fourth embodiment. In the fifth embodiment, a first filter member 424 is provided in a first path 411, and a second filter member 425 is provided fixedly in a second path so as to block the second path 412. The size of the cross section of the second filter member 425 is equal to the size of the cross section of the second path 412 at a position where the second filter member 425 is provided. The second filter member 425 is used for a filter member with a weight smaller than that of the first filter member 424 and with low pressure loss characteristics.

According to the image forming apparatus, an air flow A1 all goes through the first path 411 and passes through the first filter member 424 in the first state. On the other hand, in the second state, an air flow A2 all goes through the second path 412 and passes the second filter member 425. Therefore, it becomes possible to trap the ultra fine particles and particles with a particle size larger than the ultra fine particles, so that the image forming apparatus can more reliably prevent diffusion of the ultra fine particles to the environment inside and around the apparatus. Moreover, in the second state, the air flow A2 all goes through the second path 412. In this case, the second path 412 has the second filter member 425 provided with pressure loss characteristics lower than that of the first filter member 424. Therefore, in the second state, the air flow A2 can smoothly go through the duct 400 as compared with the case in the first state.

It is to be noted that operation of a passage switching valve 405 is identical to that in the fourth embodiment, and therefore detailed explanation thereof is omitted.

Sixth Embodiment

Figure 9A:
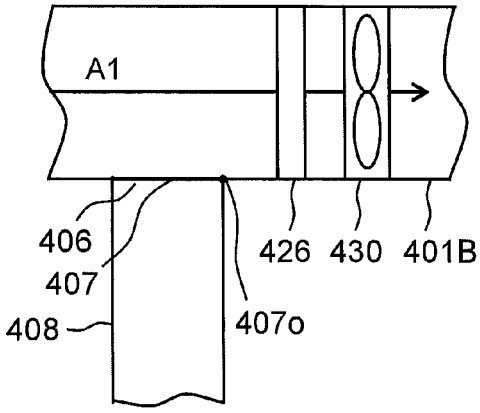
FIGS. 9A and 9B are detail views showing configuration and operation inside the duct and an auxiliary duct of the image forming apparatus, respectively.

FIG. 9A shows a configuration inside the expanded section 401B and an auxiliary duct 408 of the image forming apparatus 100, and more specifically shows a cross sectional configuration of one aspect of the expanded section 401B and the auxiliary duct 408. It is to be noted that in the sixth embodiment, component members identical to those in the first embodiment are designated by identical reference signs to omit explanation.

As shown in FIG. 9A, a first filter member 426 is fixedly provided in the expanded section 401B on the upstream of the exhaust fan 430 so as to close the expanded section 401B. The size of the cross section of the first filter member 426 is equal to the size of the cross section of the expanded section 401B at a position where the first filter member 426 is provided. An outside air introduction port 406 is provided in the expanded section 401B upstream from the first filter member 426. The auxiliary duct 408 is provided so that one end thereof (lower end in FIG. 9A) is open to the outside of the main body casing 101 or to a part distant from the fixing device 130 inside the main body casing 101, while the other end thereof (upper end in FIG. 9A) communicates with the outside air introduction port 406. An outside air introduction valve 407 as an opening and closing mechanism is provided, in this example, rotatably around a axis 407*o* which is provided in the expanded section 401B and which is perpendicular to the page of FIG. 9A. Accordingly, in the state shown in FIG. 9A, i.e., in the state where the outside air introduction port 406 is closed with the outside air introduction valve 407, only an air flow (shown with an arrow A1 in this drawing as well as in the following FIG. 10A and FIG. 11A) A1 generated with the exhaust fan 430 passes through the first filter member 426. This state is defined as a closed state. On the other hand, in the state shown in FIG. 9B, the outside air introduction valve 407 is in a position parallel to and in the vicinity of a sidewall of the auxiliary duct 408. As a consequence, an outside air flow A2 that is the air outside the main body casing 101 or the air in a part distant from the fixing device 130 in the main body casing 101 is sucked with the exhaust fan 430 and goes through the auxiliary duct 408 before joining an air flow A1 (shown with an arrow A2 in the drawing as well as in the following FIG. 10B and FIG. 11B). This state is defined as a first state. The outside air introduction valve 407 is provided so as to be able to switch between the opened state and the closed state with an unshown outside air introduction valve switching mechanism. The outside air introduction valve 407 is also controlled by the control section 200.

Figure 14A:
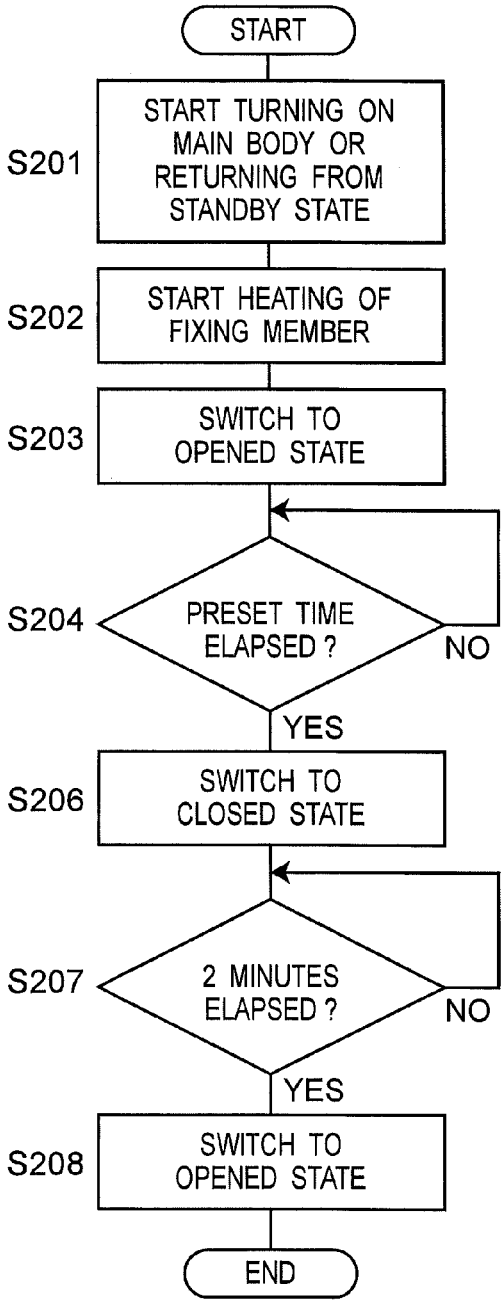
FIGS. 14A and 14B are flow charts for control of an opening and closing mechanism of the auxiliary duct by the control section of the image forming apparatus, respectively.

FIG. 14A shows a flow chart for control of the outside air introduction valve 407 by the control section 200 of the image forming apparatus 100. Description is now given of the operation of the outside air introduction valve 407 with reference to FIG. 9A, FIG. 9B and FIG. 14A.

Figure 9B:
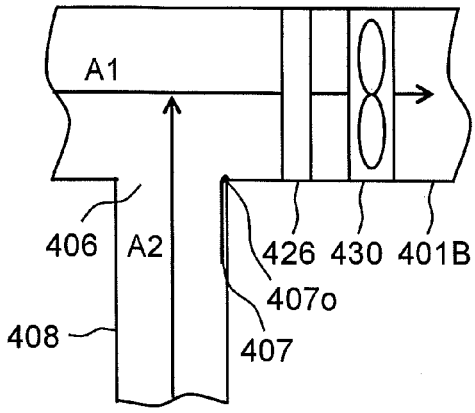

(i) After processing of Steps S201 and S202 in FIG. 14A (similar to Steps S1 and S2 in FIG. 12A), the control section 200 controls the outside air introduction valve 407 so as to switch to the opened state (Step S203 in FIG. 14A, FIG. 9B). Next, the control section 200 determines whether or not a preset time set as a period of time until the start of emission of ultra fine particles has elapsed (Step S204 in FIG. 14A). More specifically, the control section 200 determines whether or not 30 seconds, that is a preset second standby time, has elapsed after the start of heating of the heating roller 132 upon turning on the image forming apparatus 100, or determines whether or not 20 seconds, that is a preset second standby time, has elapsed after the start of heating of the heating roller 132 upon returning from the standby state of the image forming apparatus 100. If the control section 200 determines that the preset time has not yet elapsed ("NO" in Step S204 in FIG. 14A), then it determines whether or not the preset time has elapsed again (Step S204 in FIG. 14A). Consequently, in the image forming apparatus 100, an outside air flow A2 is introduced into the air flow A1 heated with the heating roller 132 until the preset time elapses after the start of heating of the heating roller 132. Since the control section 200 controls the outside air introduction valve 407 based on the time, the outside air introduction valve 407 can be controlled with simple configuration as compared with the case of using sensors and the like. Therefore, an influence of heat upon the first filter member 426 by the air flow A1 can be suppressed with simple configuration.

(ii) On the other hand, if the control section 200 determines that the preset time has elapsed ("YES" in Step S204 in FIG. 14A), then it controls the outside air introduction valve 407 so as to switch from the opened state to the closed state (Step S206 in FIG. 12A, FIG. 14A).

(iii) Next, the control section 200 determines whether or not 2 minutes, that is a preset third operating time as a period of time from the time when the emission of ultra fine particles is rapidly increased to the time when the emission is settled down after the second standby time, has elapsed (Step S207 in FIG. 14A). If the control section 200 determines that 2 minutes has not yet elapsed ("NO" in Step S207 in FIG. 14A), then it determines whether or not 2 minutes has elapsed again (Step S207 in FIG. 14A). If the control section 200 determines that 2 minutes has elapsed ("YES" in Step S207 in FIG. 14A), then it controls the outside air introduction valve 407 so as to switch from the closed state to the opened state (Step S208 in FIG. 14A, FIG. 9B). As a consequence, since the air flow A1 heated with the heating roller 132 and the outside air flow A2 pass through the first filter member 426 except for the 2 minutes that is one of the initial burst conditions, an influence of heat upon the first filter member 426 can reliably be suppressed as compared with the case when only the air flow A1 constantly passes through the first filter member 426. Further, since only the air flow A1 containing a large number of the ultra fine particles passes through the first filter member 426 only for 2 minutes while the initial burst is happening, the ultra fine particles can efficiently be trapped with the first filter member 426 as compared with the case when the outside air flow A2 is constantly introduced into the air flow A1.

As described in (i) to (iii), the control section 200 determines whether or not the preset time has elapsed, i.e., determines whether or not initial burst conditions are fulfilled, based on which the outside air introduction valve 407 is controlled so as to switch to the opened state or to the closed state. Accordingly, it becomes possible to efficiently trap the ultra fine particles and to suppress an influence of heat upon the first filter member 426. Therefore, according to the image forming apparatus 100, it becomes possible to prevent diffusion of the ultra fine particles to the environment inside and around the apparatus and to lengthen the life span of the first filter member 426.

Figure 14B:
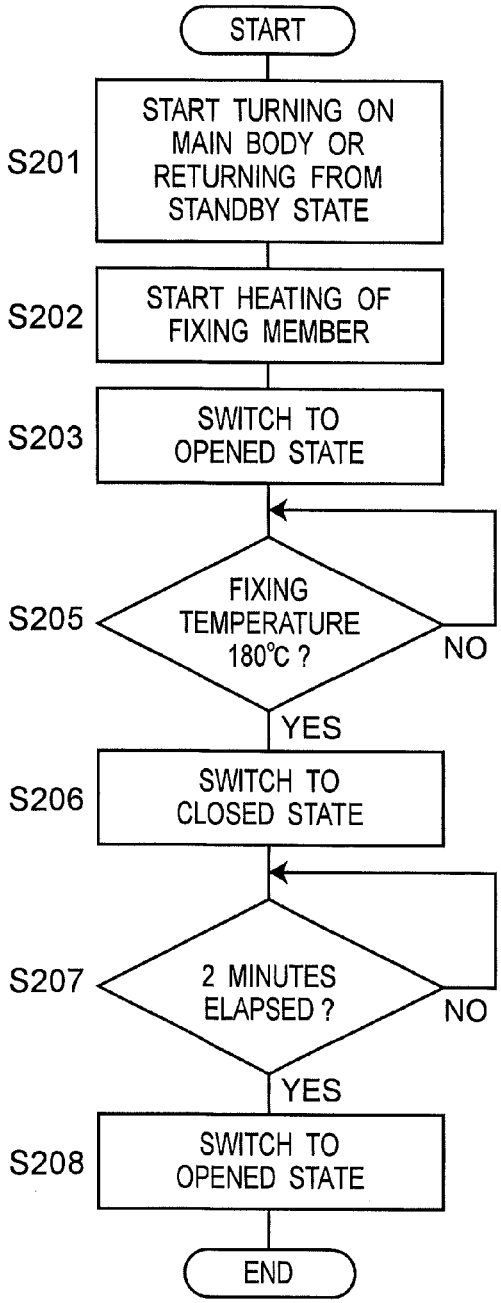

The control section 200 may control the outside air introduction valve 407 according to the control shown in the flowchart for control in FIG. 14B in place of the flowchart in FIG. 14A. It is to be noted that in the flow chart of FIG. 14B, the steps identical to those in the flowchart of FIG. 14A are designated by identical step number to omit detailed explanation.

(i') As shown in FIG. 14B, in place of Step S204 of FIG. 14A, the initial burst conditions are determined based on the fixing temperature. In this case, the control section 200 determines whether or not the fixing temperature of the heating roller 132 measured with the temperature sensor 311 has reached 180° C., that is a second threshold temperature set as the temperature at which siloxane emission rapidly increases (Step S205 in FIG. 14B). If the control section 200 determines that the fixing temperature has not yet reached 180° C. ("NO" in Step S205 in FIG. 14B), it determines whether or not the fixing temperature has reached 180° C. again (Step S205 in FIG. 14B). Accordingly, the outside air flow A2 is introduced to the air flow A1 heated with the heating roller 132 until the temperature of the heating roller 132 measured with the temperature sensor 311 has reached 180° C. that is one of the initial burst conditions. Since the control section 200 controls the outdoor air introduction valve 407 based on the temperature, heat can be controlled more precisely as compared with the case when the control section 200 controls the outdoor air introduction valve 407 based on the time. Therefore, it becomes possible to reliably suppress an influence of heat upon the first filter member 426 by the air flow A1 as compared with the case when only the air flow A1 constantly passes through the first filter member 426.

(ii') If the control section 200 determines that the fixing temperature has reached 180° C. ("YES" in Step S205 in FIG. 14B), then it controls the outside air introduction valve 407 so as to switch from the opened state to the closed state (Step S206 in FIG. 14B, FIG. 9A).

(iii') Next, the control section 200 determines whether or not 2 minutes, that is a preset fourth operating time as a period of time from the time when the emission of ultra fine particles is rapidly increased to the time when the emission is settled down, after attaining to the second threshold temperature, has elapsed (Step S207 in FIG. 14B). As the process thereafter is similar to that in the flow chart of FIG. 14A, detailed explanation thereof will be omitted.

As described in (i') to (iii'), the control section 200 determines whether or not the fixing temperature of the heating roller 132 measured with the temperature sensor 311 has reached 180° C., i.e., determines whether or not the initial burst conditions are fulfilled, based on which the outside air introduction valve 407 is controlled so as to switch to the opened state or to the closed state. Accordingly, it becomes possible to efficiently trap the ultra fine particles and to suppress an influence of heat upon the first filter member 426. Therefore, according to the image forming apparatus 100, it becomes possible to prevent diffusion of the ultra fine particles to the environment inside and around the apparatus and to lengthen the life span of the first filter member 426.

Seventh Embodiment

Figure 10A:
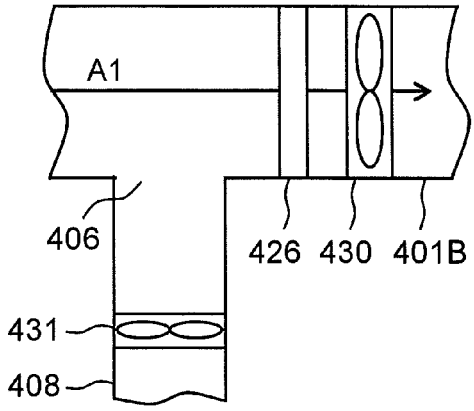
FIGS. 10A and 10B are detail views showing configuration and operation inside the duct and an auxiliary duct of the image forming apparatus, respectively.

FIG. 10A shows a configuration inside the expanded section 401B and the auxiliary duct 408 of the image forming apparatus 100, and more specifically shows a cross sectional configuration of the expanded section 401B and the auxiliary duct 408 in one aspect. It is to be noted that in the seventh embodiment, component members identical to those in the sixth embodiment are designated by identical reference signs to omit explanation.

As shown in FIG. 10A, the outside air introduction fan 431 is provided inside the auxiliary duct 408. In this example, the outside air introduction valve 407 is not provided. In the state shown in FIG. 10A, i.e., in the state where the outside air introduction fan 431 does not rotate, only an air flow A1 passes a first filter member 426. In the state shown in FIG. 10B, i.e., in the state where the outside air introduction fan 431 rotates, an outside air flow A2 passes the auxiliary duct 408 and joins the air flow A1.

Figure 15A:
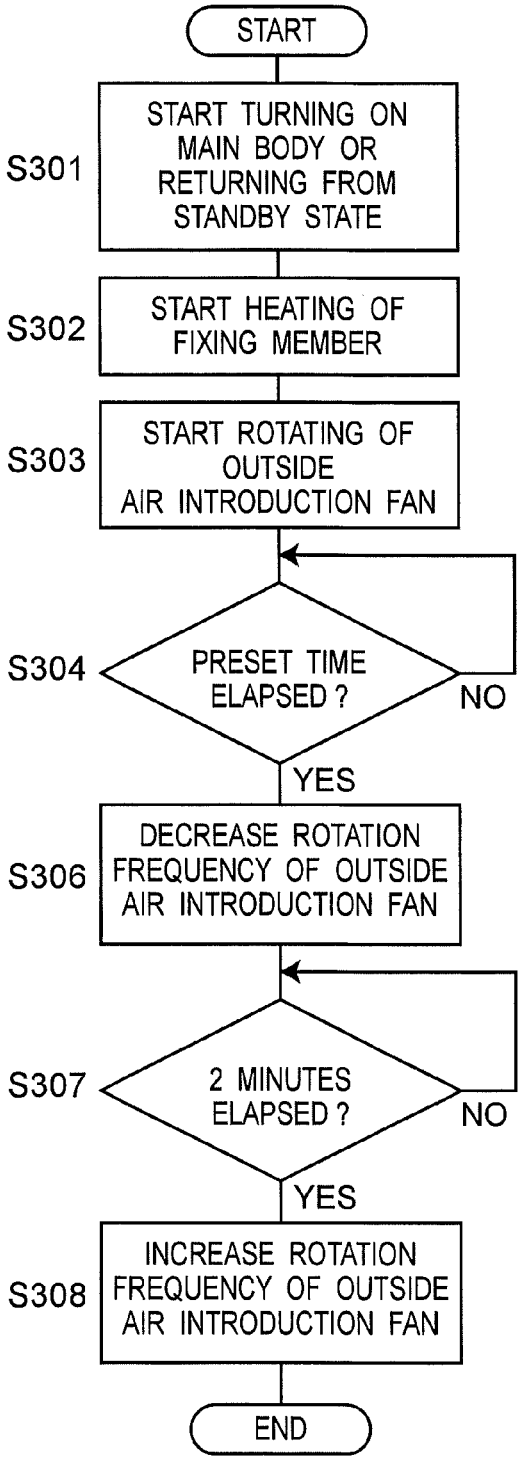
FIGS. 15A and 15B are flow charts for control of an opening and closing mechanism of the auxiliary duct by the control section of the image forming apparatus, respectively.

FIG. 15A shows a flow chart for control of the outside air introduction fan 431 by the control section 200 of the image forming apparatus 100. Description is now given of the operation of the outside air introduction fan 431 with reference to FIG. 10A, FIG. 10B and FIG. 15A.

Figure 10B:
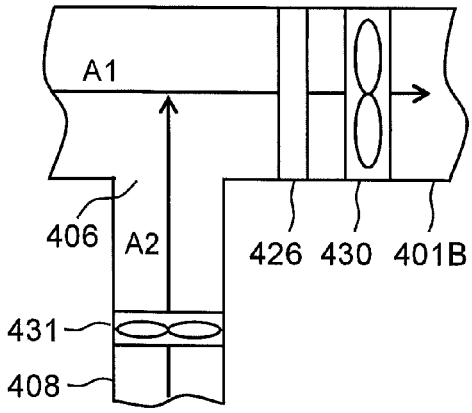

(i) After processing of Steps S301 and S302 in FIG. 15A (similar to Steps S1 and S2 in FIG. 12A), the control section 200 controls the outside air introduction fan 431 so as to start rotation of the outside air introduction fan 431 (Step S303 in FIG. 15A, FIG. 10B). Next, the control section 200 determines whether or not a preset time set as a period of time until the start of emission of ultra fine particles has elapsed (Step S304 in FIG. 15A). More specifically, the control section 200 determines whether or not 30 seconds, that is a preset third standby time, has elapsed after the start of heating of the heating of roller 132 upon turning on the image forming apparatus 100, or determines whether or not 20 seconds, that is a preset third standby time, has elapsed after the start of heating of the heating roller 132 upon returning from the standby state of the image forming apparatus 100. If the control section 200 determines that the preset time has not yet elapsed ("NO" in Step S304 in FIG. 15A), then it determines whether or not the preset time has elapsed again (Step S304 in FIG. 15A). Accordingly, in the image forming apparatus 100, the outside air introduction fan 431 is rotated to introduce an outside air flow A2 into the air flow A1 heated with the heating roller 132 until the preset time elapses after the start of heating of the heating roller 132. Since the control section 200 controls the outside air introduction fan 431 based on time, it can be controlled with simple configuration as compared with the case of using sensors and the like. Therefore, an influence of heat upon the first filter member 426 by the air flow A1 can be suppressed with simple configuration.

(ii) If the control section 200 determines that the preset time has elapsed ("YES" in Step S304 in FIG. 15A), then it controls the outside air introduction fan 431 so as to decrease rotation of the outside air introduction fan 431 (Step S306 in FIG. 15A, FIG. 10A).

(iii) Next, the control section 200 determines whether or not 2 minutes, that is a preset fifth operating time as a period of time from the time when the emission of ultra fine particles is rapidly increased to the time when the emission is settled down after the first standby time, has elapsed (Step S307 in FIG. 15A). If the control section 200 determines that 2 minutes has not yet elapsed ("NO" in Step S307 in FIG. 15A), then it determines whether or not 2 minutes has elapsed again (Step S307 in FIG. 15A). If the control section 200 determines that 2 minutes has elapsed ("YES" in Step S307 in FIG. 15A), then it controls the outside air introduction fan 431 to increase rotation (Step S308 in FIG. 15A, FIG. 10B). Accordingly, since the air flow A1 heated with the heating roller 132 and the outside air flow A2 pass through the first filter member 426 except for the 2 minutes that is one of the initial burst conditions, an influence of heat upon the first filter member 426 can reliably be suppressed as compared with the case when only the air flow A1 constantly passes through the first filter member 426. Further, since the amount of the outside air flow A2 passing through the first filter member 426 decreases only for 2 minutes while the initial burst is happening, the ultra fine particles can efficiently be trapped with the first filter member 426 as compared with the case when a fixed amount of the outside air flow A2 is constantly introduced into the air flow A1.

As described in (i) to (iii), the control section 200 determines whether or not the preset time has elapsed, i.e., determines whether or not initial burst conditions are fulfilled, based on which the outside air introduction fan 431 is controlled to control the rotation frequency of the outside air introduction fan 431. Consequently, it becomes possible to efficiently trap the ultra fine particles and to suppress an influence of heat upon the first filter member 426. Therefore, according to the image forming apparatus 100, it becomes possible to prevent diffusion of the ultra fine particles to the environment inside and around the apparatus and to lengthen the life span of the first filter member 426.

Figure 15B:
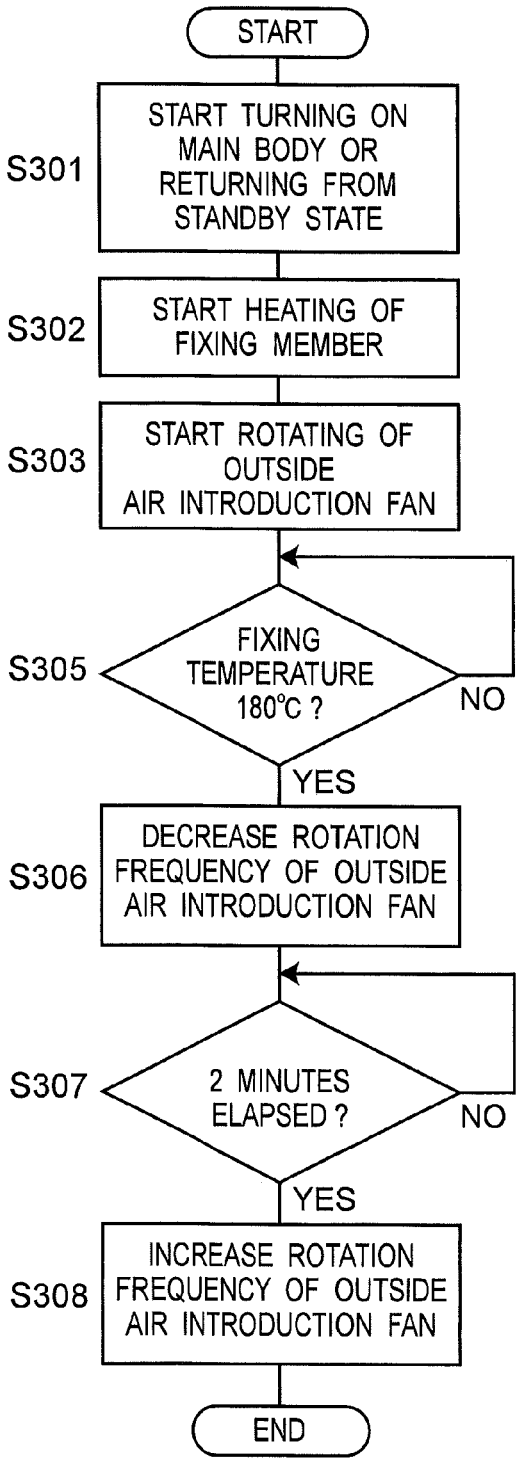

The control section 200 may control the outside air introduction fan 431 according to the control shown in the flow chart for control in FIG. 15B in place of the flow chart in FIG. 15A. It is to be noted that in the flow chart of FIG. 15B, the steps identical to those in the flow chart of FIG. 15A are designated by identical step number to omit detailed explanation.

(i') As shown in FIG. 15B, in place of Step S304 of FIG. 15A, the initial burst conditions are determined based on a fixing temperature. In this case, the control section 200 determines whether or not the fixing temperature of the heating roller 132 measured with the temperature sensor 311 has reached 180° C., that is a third threshold temperature set as the temperature at which siloxane emission rapidly increases (Step S305 in FIG. 15B). If the control section 200 determines that the fixing temperature has not yet reached 180° C. ("NO" in Step S305 in FIG. 15B), it determines whether or not the fixing temperature has reached 180° C. again (Step S305 in FIG. 15B). Accordingly, the outside air flow A2 is introduced to the air flow A1 heated with the heating roller 132 until the temperature of the heating roller 132 measured with the temperature sensor 311 has reached 180° C. that is one of the initial burst conditions. Since the control section 200 controls the outside air introduction fan 431 based on the temperature, heat can be controlled more precisely as compared with the case when the control section 200 controls the outside air introduction fan 431 based on the time. Therefore, it becomes possible to reliably suppress an influence of heat upon the first filter member 426 by the air flow A as compared with the case when only the air flow A1 constantly passes through the first filter member 426.

(ii') If the control section 200 determines that the fixing temperature has reached 180° C. ("YES" in Step S305 in FIG. 15B), then it controls the outside air introduction fan 431 so as to decrease rotation of the outside air introduction fan 431 (Step S306 in FIG. 15B, FIG. 10A).

(iii') Next, the control section 200 determines whether or not 2 minutes, that is a preset sixth operating time as a period of time from the time when the emission of ultra fine particles is rapidly increased to the time when the emission is settled down, after attaining to the third threshold temperature, has elapsed (Step S307 in FIG. 15B). As the process thereafter is similar to that in the flow chart of FIG. 15A, detailed explanation thereof will be omitted.

As described in (i') to (iii'), the control section 200 determines whether or not the fixing temperature of the heating roller 132 measured with the temperature sensor 311 has reached 180° C., i.e., determines whether or not the initial burst conditions are fulfilled, based on which the outside air introduction fan 431 is controlled to control the rotation frequency of the outside air introduction fan 431. Accordingly, it becomes possible to efficiently trap the ultra fine particles and to suppress an influence of heat upon the first filter member 426. Therefore, according to the image forming apparatus 100, it becomes possible to prevent diffusion of the ultra fine particles to the environment inside and around the apparatus and to lengthen the life span of the first filter member 426.

Eighth Embodiment

Figure 11A:
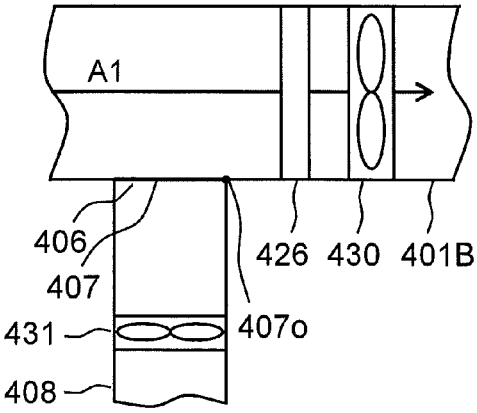
FIGS. 11A and 11B are detail views showing configuration and operation inside the duct and an auxiliary duct of the image forming apparatus, respectively.

FIG. 11A shows a configuration inside the expanded section 401B and the auxiliary duct 408 of the image forming apparatus 100, and more specifically shows a cross sectional configuration of the expanded section 401B and the auxiliary duct 408 in one aspect. It is to be noted that in the eighth embodiment, component members identical to those in the sixth embodiment are designated by identical reference signs to omit explanation.

As shown in FIG. 11A, the outside air introduction fan 431 is provided inside the auxiliary duct 408. In the state shown in FIG. 11A, i.e., in the closed state where the outside air introduction fan 431 does not rotate, only an air flow A1 passes a first filter member 426. In the state shown in FIG. 11B, i.e., in the opened state where the outside air introduction fan 431 rotates, an outside air flow A2 goes through the auxiliary duct 408 and joins the air flow A1.

Figure 16A:
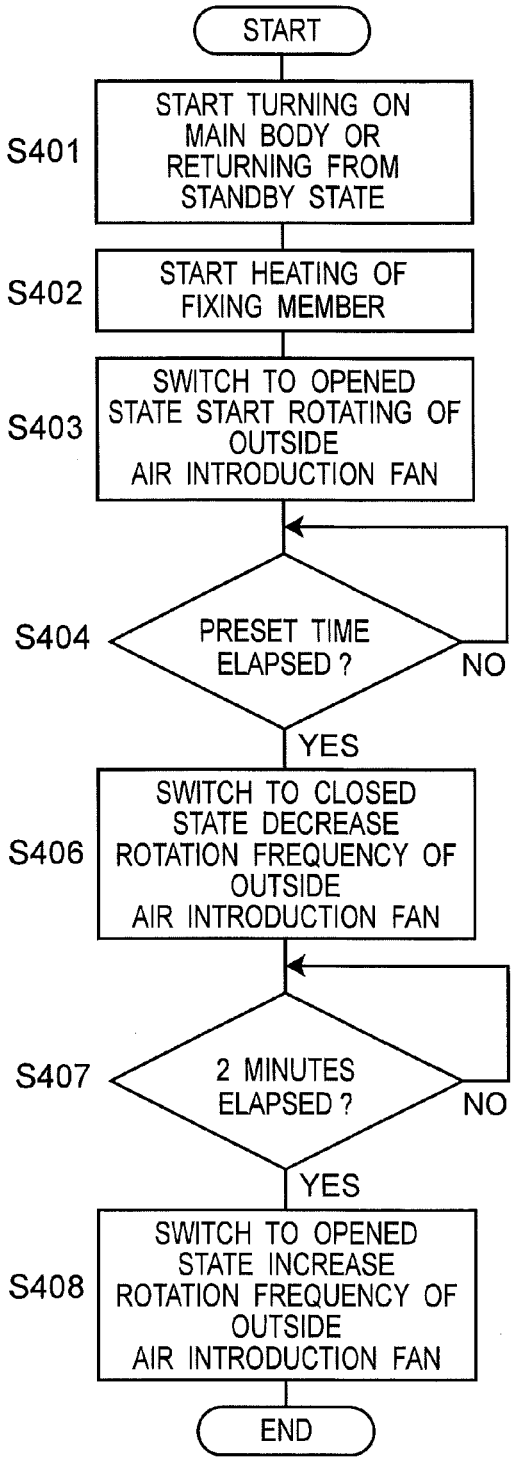
FIGS. 16A and 16B are flow charts for control of an opening and closing mechanism and an outside air introduction fan of the auxiliary duct by the control section of the image forming apparatus, respectively.

FIG. 16A shows a flow chart for control of the outside air introduction valve 407 and the outside air introduction fan 431 by a control section 200 of the image forming apparatus 100. Description is now given of the operation of the outside air introduction valve 407 and the outside air introduction fan 431 with reference to FIG. 11A, FIG. 11B, and FIG. 16A.

Figure 11B:
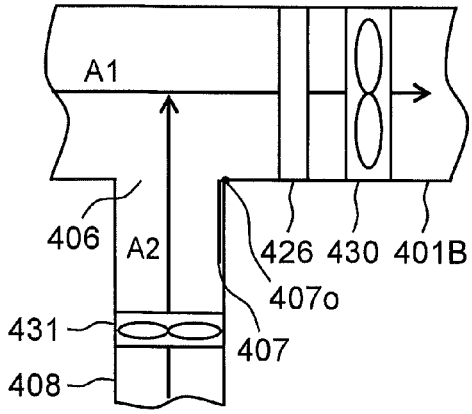

(i) After processing of Steps S401 and S402 in FIG. 16A (similar to Steps S1 and S2 in FIG. 12A), the control section 200 controls the outside air introduction valve 407 so as to switch to the opened state, while controlling the outside air introduction fan 431 to start rotation of the outside air introduction fan 431 (Step S403 in FIG. 16A, FIG. 11B). Next, the control section 200 performs processing of Step S404 in FIG. 16A (similar to the processing of Step S4 in FIG. 12A). Consequently, in the image forming apparatus 100, the outside air flow A2 is introduced into the air flow A1 heated with the heating roller 132 until the preset time elapses after the start of heating of the heating roller 132. Since the control section 200 controls the outside air introduction valve 407 and the outside air introduction fan 431 based on the time, they can be controlled with simple configuration as compared with the case of using sensors and the like. Therefore, an influence of heat upon the first filter member 426 by the air flow A1 can be suppressed with simple configuration.

(ii) If the control section 200 determines that the preset time has elapsed ("YES" in Step S404 in FIG. 16A), then it controls the outside air introduction valve 407 so as to switch from the opened state to the closed state, while controlling the outside air introduction fan 431 to decrease rotation frequency of the outside air introduction fan 431 (Step S406 in FIG. 16A, FIG. 11A).

(iii) Next, after processing of Steps S407 in FIG. 16A (similar to Step S7 in FIG. 12A), the control section 200 controls the outside air introduction valve 407 so as to switch to the opened state, while controlling the outside air introduction fan 431 to increase the rotation frequency of the outside air introduction fan 431 (Step S408 in FIG. 16A, FIG. 11B). As a consequence, since the air flow A1 heated with the heating roller 132 and the outside air flow A2 pass through the first filter member 426 except for the 2 minutes that is one of the initial burst conditions, an influence of heat upon the first filter member 426 can reliably be suppressed as compared with the case when only the air flow A1 constantly passes through the first filter member 426. Further, since only the air flow A1 containing a large number of the ultra fine particles passes through the first the filter member 426 only for 2 minutes while the initial burst is happening, the ultra fine particles can efficiently be trapped with the first filter member 426 as compared with the case when the outside air flow A2 is constantly introduced into the air flow A1.

As described in (i) to (iii), the control section 200 determines whether or not the preset time has elapsed, i.e., determines whether or not initial burst conditions are fulfilled. Based on the determination, the control section 200 controls the outside air introduction valve 407 so as to switch to the opened state or to the closed state, while controlling the outside air introduction fan 431 to increase or decrease the rotation frequency of the outside air introduction fan 431. Accordingly, it becomes possible to efficiently trap the ultra fine particles and to suppress an influence of heat upon the first filter member 426. Therefore, according to the image forming apparatus 100, it becomes possible to prevent diffusion of the ultra fine particles to the environment inside and around the apparatus and to lengthen the life span of the first filter member 426.

Figure 16B:
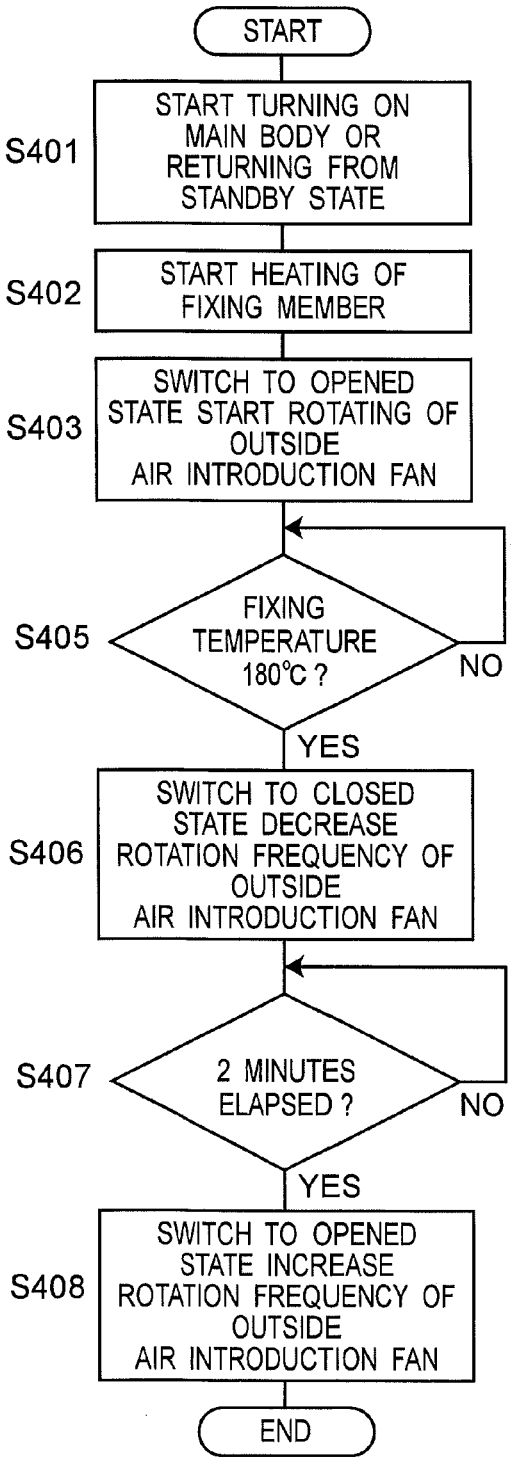

The control section 200 may control the outside air introduction valve 407 and the outside air introduction fan 431 according to the control shown in the flow chart for control in FIG. 16B in place of the flow chart in FIG. 16A. It is to be noted that in the flow chart of FIG. 16B, the steps identical to those in the flow chart of FIG. 16A are designated by identical step number to omit detailed explanation.

(i') As shown in FIG. 16B, in place of Step S404 of FIG. 16A, the initial burst conditions are determined based on fixing temperature. In this case, the control section 200 determines whether or not the fixing temperature of the heating roller 132 measured with the temperature sensor 311 has reached 180° C., that is a third threshold temperature set as the temperature at which siloxane emission rapidly increases (Step S405 in FIG. 16B). If the control section 200 determines that the fixing temperature has not yet reached 180° C. ("NO" in Step S405 in FIG. 16B), it determines whether or not the fixing temperature has reached 180° C. again (Step S405 in FIG. 16B). Accordingly, the outside air flow A2 is introduced to the air flow A1 heated with the heating roller 132 until the temperature of the heating roller 132 measured with the temperature sensor 311 has reached 180° C. that is one of the initial burst conditions. Since the control section 200 controls the outside air introduction valve 407 and the outside air introduction fan 431 based on the temperature, heat can be controlled more precisely as compared with the case when the control section 200 controls the outside air introduction valve 407 and the outside air introduction fan 431 based on the time. Therefore, it becomes possible to reliably suppress an influence of heat upon the first filter member 426 by the air flow A1 as compared with the case when only the air flow A1 constantly passes through the first filter member 426.

(ii') If the control section 200 determines that the fixing temperature has reached 180° C. ("YES" in Step S405 in FIG. 16B), then it controls the outside air introduction valve 407 so as to switch to the closed state, while controlling the outside air introduction fan 431 to decrease rotation frequency of the outside air introduction fan 431 (Step S406 in FIG. 16B, FIG. 11A).

(iii') Next, the control section 200 performs processing of Step S407 in FIG. 16A (similar to the processing of Step S7 in FIG. 12A). As the process thereafter is similar to that in the flow chart of FIG. 16A, detailed explanation thereof will be omitted.

As described in (i') to (iii'), the control section 200 determines whether or not the fixing temperature of the heating roller 132 measured with the temperature sensor 311 has reached 180° C., i.e., determines whether or not the initial burst conditions are fulfilled. Based on the determination, the control section 200 controls the outside air introduction valve 407 so as to switch to the opened state or to the closed state, while controlling the outside air introduction fan 431 to increase or decrease the rotation frequency of the outside air introduction fan 431. Accordingly, it becomes possible to efficiently trap the ultra fine particles and to suppress an influence of heat upon the first filter member 426. Therefore, according to the image forming apparatus 100, it becomes possible to prevent diffusion of the ultra fine particles to the environment inside and around the apparatus and to lengthen the life span of the first filter member 426.

Thus, in the image forming apparatus 100, the control section 200 controls the outside air introduction valve 407 and the outside air introduction fan 431 to switch between the opened state and the closed state and to increase or decrease the rotation frequency of the outside air introduction fan 431. Consequently, the control section 200 can reliably control the air flow A1 as compared with the case when the outside air introduction valve 407 or the outside air introduction fan 431 is controlled. Therefore, an influence of heat upon the first filter member 420 can be suppressed with more reliability.

In the second and third embodiments, the center of the expanded section 401B of the duct 400 and the first filter member 422 are used as a rotational center. It should naturally be understood that without being limited thereto, the rotational center in the invention may be at any position as long as the first filter member can be rotated by almost 90 degrees.

In each of the above-stated embodiments, the temperature sensor 311 is provided so as to be in contact with the heating roller 132. It should naturally be understood that without being limited thereto, the temperature sensor 311 may be provided so as not to be in contact with the heating roller 132 in the invention.

In each of the above-stated embodiments, the exhaust fan 430 was structured to be placed inside the expanded section 401B. It should naturally be understood that the invention is not limited thereto but is preferably applicable to the case where the exhaust fan 430 is placed outside the duct 400 as long as the exhaust fan 430 is placed in the vicinity of the end portions of the duct 400.

In each of the above-stated embodiments, the fixing member was configured as a cylindrical fixing roller. It should naturally be understood that the present invention is not limited thereto but is preferably applicable to the case where the fixing member is an annular fixing belt.

In each of the above-mentioned embodiments, the pressure roller can also be considered as a fixing member. A heater may be built not only in the fixing roller but also in the pressure roller.

Although the invention was applied to a tandem type color image forming apparatus in each of the above-stated embodiments, the invention is not limited to this configuration. The photoconductor, the charging means, the exposure means, the developing means, the transfer means, and the fixing means are not limited to have the configuration and layout disclosed in the embodiments but may have other configurations and layouts. The invention is widely applicable to the image forming apparatuses of other types such as rotary configuration type and direct transfer type.

Although the filter member was provided upstream from the exhaust fan in each of the above-stated embodiments, the filter member may be placed downstream from the exhaust fan.

The invention is also applicable to printers, copying machines, facsimiles, multi-functional machines having the functions of these and hard copy systems for data processing/editing and printing.

As described above, an image forming apparatus in one aspect of the present invention comprises:

a fixing member having a cylindrical or annular shape for fixing an image onto a sheet which is in pressure contact with an outer surface thereof;

a heating source for heating the fixing member to a fixing temperature;

a duct which is provided in a position facing the fixing member with respect to a width direction perpendicular to a circumferential direction of the fixing member and which has an inlet for taking in fine particles generated from the fixing member;

an exhaust fan provided inside the duct or in an outlet of the duct for generating an air flow going from the inlet to the outlet of the duct;

a first filter member which is provided upstream or downstream from the exhaust fan inside the duct and which can trap the fine particles which flow through the duct getting on the air flow; and a control section for controlling an amount of the air flow passing through the first filter member according to initial burst conditions under which the fine particles are emitted from the fixing member.

In the image forming apparatus of this invention, the fixing member is heated with the heating source to a specified target temperature (a fixing temperature). A conveyed sheet is brought into pressure contact with the outer surface of the fixing member to fix an image onto the sheet. Once the fixing member is heated to around the fixing temperature, ultra fine particles such as siloxane (with a particle size of 100 nm or less) are rapidly generated from, for example, the rubber layer of the fixing member. Since the outer surface of the rubber layer is generally covered with the outer layer, the ultra fine particles are likely to be emitted from the end portion of the rubber layer. In this image forming apparatus, the fine particle which are likely to be emitted from the end portion of the rubber layer are taken into the duct through an inlet provided in a position facing the fixing member with respect to a width direction perpendicular to the circumferential direction of the fixing member. The fine particles taken into the duct flow through the duct from the inlet toward the outlet of the duct getting on the air flow generated with the exhaust fan provided in the duct or in the outlet. The fine particles which flow through the duct are trapped with the first filter member provided upstream or downstream from the exhaust fan in the duct. As a result, the image forming apparatus can prevent diffusion of fine particles to the environment inside and around the apparatus.

Moreover, the emission of the ultra fine particles occurs only when specific temperature or time is satisfied, that is, only when initial burst conditions are fulfilled. Accordingly, in the image forming apparatus of the invention, the control section controls the air flow heated with the fixing member and passing through the first filter member according to the initial burst conditions. In short, only when the specific temperature or time is satisfied, the air flow passes through the first filter member. As a consequence, an influence of heat upon the first filter member can be suppressed. Therefore, according to the image forming apparatus, it becomes possible to prevent diffusion of fine particles to the environment inside and around the apparatus and to lengthen the life span of the first filter member.

The image forming apparatus of one embodiment comprises:

inside the duct, a switching mechanism capable of switching between a first state in which the air flow passes through the first filter member and a second state in which the air flow avoids the first filter member, and wherein the control section controls the switching mechanism so as to switch between the first state and the second state according to the initial burst conditions.

In the image forming apparatus of this one embodiment, the control section controls the switching mechanism according to the initial burst conditions so as to switch between the first state in which the air flow passes through the first filter member and the second state in which the air flow avoids the first filter member. Therefore, in the second state, the air flow heated with the fixing member does not pass through the first filter member, so that an influence of heat upon the first filter member by the air flow can reliably suppressed as compared with the case when the air flow constantly passes through the first filter member.

The image forming apparatus of one embodiment comprises:

inside the duct, a first path having the first filter member capable of trapping ultra fine particles; and a second path placed parallel to the first path and having a second filter member capable of trapping particles other than the ultra fine particles, wherein the switching mechanism are controlled to switch between the first path for forming the first state and the second path for forming the second state by the control section.

In the image forming apparatus of this one embodiment, the switching mechanism is controlled to switch between the first path in which the first filter member is placed and the second path in which the second filter member capable of trapping particles other than the ultra fine particles is placed by the control section. Accordingly, all of the air flowpasses through the first filter member or the second filter member. Therefore, according to the image forming apparatus, diffusion of the ultra fine particles to the environment inside or around the apparatus can be prevented with more reliability.

In the image forming apparatus of one embodiment, the control section controls the air flow according to the initial burst conditions, depending on whether or not a preset first standby time has elapsed after start of heating of the fixing member upon turning on a main body of the image forming apparatus or upon returning from standby state of the main body of the image forming apparatus.

In the image forming apparatus of this one embodiment, it is possible to control, for example, to prevent the air low heated with the fixing member from passing through the first filter member until the preset first standby time elapses after the start of heating of the fixing member. Since the control section controls the air flow based on the time, the air flow can be controlled with simple configuration as compared with the case of using sensors and the like. Therefore, an influence of heat upon the first filter member by the air flow can be suppressed with simple configuration.

In the image forming apparatus of one embodiment, the control section controls the switching mechanism so as to switch from the second state to the first state only for a preset first operating time after the first standby time has elapsed.

In the image forming apparatus of this one embodiment, the control section controls the switching mechanism so as to switch from the second state to the first state only for the preset first operating time after the elapse of the first standby time. Therefore, since the air flow heated with the fixing member does not pass through the first member except for the first operating time, an influence of heat upon the first filter member can reliably be suppressed as compared with the case when the air flow constantly passes through the first filter member.

The image forming apparatus of one embodiment comprises:

a temperature sensor for measuring temperature of the fixing member, wherein the control section controls the air flow according to the initial burst conditions, depending on whether or not the temperature of the fixing member measured with the temperature sensor has reached a preset first threshold temperature.

In the image forming apparatus of this one embodiment, it is possible to control, for example, to prevent the air flow heated with the fixing member from passing the first filter member until the temperature of the fixing member measured with the temperature sensor has reached the preset first threshold temperature. Since the control section controls the air flow based on the temperature, heat can be controlled more precisely as compared with the case when the control section controls the air flow based on the time. Therefore, it becomes possible to reliably suppress an influence of heat upon the first filter member with the air flow as compared with the case when the air flow constantly passes through the first filter member.

In the image forming apparatus of one embodiment, the control section controls the switching mechanism so as to switch from the second state to the first state only for a preset second operating time after the temperature of the fixing member measured with the temperature sensor has reached the preset first threshold temperature.

In the image forming apparatus of this one embodiment, the control section controls the switching mechanism to switch from the second state to the first state only for the preset second operating time after the temperature of the fixing member measured with the temperature sensor has reached the first threshold temperature. Therefore, since the air flow heated with the fixing member does not pass through the first member except for the second operating time, an influence of heat upon the first filter member can reliably be suppressed as compared with the case when the air flow constantly passes through the first filter member.

The image forming apparatus of one embodiment comprises:

an outside air introduction port provided upstream from the first filter member with respect to the air flow in the duct; and an opening and closing mechanism capable of switching between an opened state in which air from outside a casing of the image forming apparatus or from a part distant from the fixing member inside the casing is introduced into the duct through the outside air introduction port and a closed state in which the outside air introduction port is blocked, wherein the control section controls the opening and closing mechanism so as to switch between the opened state and the closed state according to the initial burst conditions.

In the image forming apparatus of this one embodiment, the control section controls the opening and closing mechanism according to the initial burst conditions so as to switch between the opened state for introducing the outside air, that is air from the outside of the casing of the image forming apparatus or from a part distant from the fixing member inside the casing, into the duct and the closed state for blocking the outside air introduction port. Therefore, since the outside air is introduced into the air flow heated with the fixing member, the heated air is cooled and thereby it becomes possible to reliably suppress an influence of the heat upon the first filter member through which the air flow.

In the image forming apparatus of one embodiment, the control section controls the air flow according to the initial burst conditions, depending on whether or not a preset second standby time has elapsed after start of heating of the fixing member upon turning on a main body of the image forming apparatus or upon returning from standby state of the main body of the image forming apparatus.

In the image forming apparatus of this one embodiment, it becomes possible to control, for example, to introduce the outside air to the air flow heated with the fixing member until the preset second standby time elapses after the start of heating of the fixing member. Since the control section controls the air flow based on the time, the air flow can be controlled with simple configuration as compared with the case of using sensors and the like. Therefore, an influence of heat upon the first filter member by the air flow can be suppressed with simple configuration.

In the image forming apparatus of one embodiment, the control section controls the opening and closing mechanism so as to switch from the opened state to the closed state only for a preset third operating time after the second standby time has elapsed.

In the image forming apparatus of this one embodiment, the control section controls the opening and closing mechanism so as to switch from the opened state to the closed state only for the preset third operating time after the elapse of the second standby time. Therefore, since the outside air is not introduced into the air flow during the third operating time, the ultra fine particles can more efficiently be trapped with the first filter member as compared with the case when the outside air is constantly introduced into the air flow.

The image forming apparatus of one embodiment comprises:

a temperature sensor for measuring temperature of the fixing member, wherein the control section controls the air flow according to the initial burst conditions, depending on whether or not the temperature of the fixing member measured with the temperature sensor has reached a preset second threshold temperature.

In the image forming apparatus of this one embodiment, it is possible to control, for example, to introduce the outside air into the air flow heated with the fixing member until the temperature of the fixing member measured with the temperature sensor has reached the preset second threshold temperature. Since the control section controls the air flow based on the temperature, heat can be controlled more precisely as compared with the case when the control section controls the air flow based on the time. Therefore, the ultra fine particles can more efficiently be trapped with the first filter member as compared with the case when the outside air is constantly introduced into the air flow.

In the image forming apparatus of one embodiment, the control section controls the opening and closing mechanism so as to switch from the opened state to the closed state only for a preset fourth operating time after the temperature of the fixing member measured with the temperature sensor has reached the second threshold temperature.

In the image forming apparatus of this one embodiment, the control section controls the opening and closing mechanism to switch from the opened state to the closed state only for the preset fourth operating time after the temperature of the fixing member measured with the temperature sensor has reached the second threshold temperature. Therefore, since the outside air is not introduced into the air flow during the fourth operating time, the ultra fine particles can more efficiently be trapped with the first filter member as compared with the case when the outside air is constantly introduced into the air flow.

The image forming apparatus of one embodiment comprises:

an auxiliary duct communicating with the outside air introduction port; and an outside air introduction fan provided inside the auxiliary duct or in an inlet thereof for introducing air from outside of the casing of the image forming apparatus or from a part inside the casing distant from the fixing member into the duct, wherein the control section controls rotation frequency of the outside air introduction fan according to the initial burst conditions.

In the image forming apparatus of this one embodiment, the control section controls rotation frequency of the outside air introduction fan according to the initial burst conditions.

Therefore, since the outside air is introduced into the air flow heated with the fixing member, the heated air is cooled and thereby it becomes possible to reliably suppress an influence of heat upon the first filter member through which the air flow.

In the image forming apparatus of one embodiment, the control section controls the air flow according to the initial burst conditions, depending on whether or not a preset third standby time has elapsed after start of heating of the fixing member upon turning on a main body of the image forming apparatus or upon returning from standby state of the main body of the image forming apparatus.

In the image forming apparatus of this one embodiment, it becomes possible to control, for example, to introduce the outside air to the air flow heated with the fixing member until the preset third standby time elapses after the start of heating of the fixing member. Since the control section controls the air flow based on the time, the air flow can be controlled with simple configuration as compared with the case of using sensors and the like. Therefore, an influence of heat upon the first filter member by the air flow can be suppressed with simple configuration.

In the image forming apparatus of one embodiment, the control section decreases rotation frequency of the outside air introduction fan only for a preset fifth operating time after the third standby time has elapsed as compared with before the third standby time has elapsed.

In the image forming apparatus of this one embodiment, the control section controls the outside air introduction fan so as to decrease the rotation frequency of the outside air introduction fan from the rotation frequency prior to the elapse of the third standby time only for the preset fifth operating time after the elapse of the third standby time. Therefore, the amount of the outside air introduced into the air flow during the fifth operating time is smaller than that before the elapse of the third standby time, so that the ultra fine particles can more efficiently be trapped with the first filter member as compared with the case when a fixed amount of the outside air is constantly introduced into the air flow.

The image forming apparatus of one embodiment comprises:

a temperature sensor for measuring temperature of the fixing member, wherein the control section controls the air flow according to the initial burst conditions, depending on whether or not the temperature of the fixing member measured with the temperature sensor has reached a preset third threshold temperature.

In the image forming apparatus of this one embodiment, it is possible to control, for example, to introduce the outside air to the air flow heated with the fixing member until the temperature of the fixing member measured with the temperature sensor has reached the preset third threshold temperature. Since the control section controls the air flow based on the temperature, heat can be controlled more precisely as compared with the case when the control section controls the air flow based on the time Therefore, the ultra fine particles can more efficiently be trapped with the first filter member as compared with the case when a fixed amount of the outside air is constantly introduced into the air flow.

In the image forming apparatus of one embodiment, the control section decreases the rotation frequency of the outside air introduction fan only for a preset sixth operating time after the temperature of the fixing member measured with the temperature sensor has reached the third threshold temperature as compared with before the temperature of the fixing member measured with the temperature sensor has reached the third threshold temperature.

In the image forming apparatus of this one embodiment, the control section decreases the rotation frequency of the outside air introduction fan from the rotation frequency before the temperature of the fixing member measured with the temperature sensor has reached the third threshold temperature only for the preset sixth operating time after the temperature of the fixing member measured with the temperature sensor has reached the third threshold temperature. Therefore, the ultra fine particles can more efficiently be trapped with the first filter member as compared with the case when a fixed amount of the outside air is constantly introduced into the air flow.

In the image forming apparatus of one embodiment, the first filter member is an electrostatic filter.

In the image forming apparatus of this one embodiment, the first filter member is an electrostatic filter. Therefore, the ultra fine particles can more efficiently be trapped due to Coulomb force.

According to the image forming apparatus in the invention, it becomes possible to prevent diffusion of fine particles to the environment inside and around the apparatus and to lengthen the life span of the filter member.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An image forming apparatus, comprising:

a fixing member having a cylindrical or annular shape for fixing an image onto a sheet which is in pressure contact with an outer surface thereof;

a heating source for heating the fixing member to a fixing temperature;

a duct which is provided in a position facing the fixing member and which has an inlet for taking in fine particles generated from the fixing member;

an exhaust fan provided inside the duct or in an outlet of the duct for generating an air flow going from the inlet to the outlet of the duct;

the duct includes a first path having a first filter member therein and a second path parallel to the first path and having a second filter member therein;

the first filter member is provided upstream or downstream from the exhaust fan inside the duct and can trap the fine particles which flow through the duct in the air flow;

the second filter member capable of trapping particles other than the fine particles;

a switching mechanism inside the duct, the switching mechanism capable of switching between a first state in which the air flows through the first path and a second state in which the air flow passes through the second path; and a control section for controlling the switching mechanism so as to switch between the first state and the second state according to initial burst conditions under which the fine particles are emitted from the fixing member.

2. The image forming apparatus as claimed in claim 1, wherein the first filter member is an electrostatic filter.

3. The image forming apparatus as claimed in claim 1, wherein the fine particles are ultra fine particles.

4. An image forming apparatus, comprising:

a fixing member having a cylindrical or annular shape for fixing an image onto a sheet which is in pressure contact with an outer surface thereof;

a heating source for heating the fixing member to a fixing temperature;

a duct which is provided in a position facing the fixing member and which has an inlet for taking in fine particles generated from the fixing member;

an exhaust fan provided inside the duct or in an outlet of the duct for generating an air flow going from the inlet to the outlet of the duct;

a first filter member which is provided upstream or downstream from the exhaust fan inside the duct and which can trap the fine particles which flow through the duct in the air flow; and a control section for controlling an amount of the air flow passing through the first filter member according to initial burst conditions under which the fine particles are emitted from the fixing member;

wherein the control section controls the air flow according to the initial burst conditions, depending on whether or not a preset standby time has elapsed after start of heating of the fixing member upon turning on a main body of the image forming apparatus or upon returning from standby state of the main body of the image forming apparatus.

5. The image forming apparatus as claimed in claim 4, further comprising:

a switching mechanism capable of switching between a first state in which the air flow passes through the first filter member and a second state in which the air flow avoids the first filter member; and wherein the control section controls the switching mechanism so as to switch from the second state to the first state only for a preset first operating time after the preset standby time has elapsed.

6. An image forming apparatus, comprising:

a fixing member having a cylindrical or annular shape for fixing an image onto a sheet which is in pressure contact with an outer surface thereof;

a heating source for heating the fixing member to a fixing temperature;

a duct which is provided in a position facing the fixing member and which has an inlet for taking in fine particles generated from the fixing member;

an exhaust fan provided inside the duct or in an outlet of the duct for generating an air flow going from the inlet to the outlet of the duct;

a first filter member which is provided upstream or downstream from the exhaust fan inside the duct and which can trap the fine particles which flow through the duct in the air flow;

a control section for controlling an amount of the air flow passing through the first filter member according to initial burst conditions under which the fine particles are emitted from the fixing member;

a temperature sensor for measuring temperature of the fixing member, wherein the control section controls the air flow according to the initial burst conditions, depending on whether or not the temperature of the fixing member measured with the temperature sensor has reached a preset threshold temperature;

a switching mechanism capable of switching between a first state in which the air flow passes through the first filter member and a second state in which the air flow avoids the first filter member; and wherein the control section controls the switching mechanism so as to switch from the second state to the first state only for a preset operating time after the temperature of the fixing member measured with the temperature sensor has reached the preset first threshold temperature.

7. An image forming apparatus, comprising:

a fixing member having a cylindrical or annular shape for fixing an image onto a sheet which is in pressure contact with an outer surface thereof;

a heating source for heating the fixing member to a fixing temperature;

a duct which is provided in a position facing the fixing member and which has an inlet for taking in fine particles generated from the fixing member;

an exhaust fan provided inside the duct or in an outlet of the duct for generating an air flow going from the inlet to the outlet of the duct;

a first filter member which is provided upstream or downstream from the exhaust fan inside the duct and which can trap the fine particles which flow through the duct in the air flow;

a control section for controlling an amount of the air flow passing through the first filter member according to initial burst conditions under which the fine particles are emitted from the fixing member;

an outside air introduction port provided upstream from the first filter member with respect to the air flow in the duct; and an opening and closing mechanism capable of switching between an opened state in which air from outside a casing of the image forming apparatus or from a part distant from the fixing member inside the casing is introduced into the duct through the outside air introduction port and a closed state in which the outside air introduction port is blocked, wherein the control section controls the opening and closing mechanism so as to switch between the opened state and the closed state according to the initial burst conditions;

wherein the control section controls the air flow according to the initial burst conditions, depending on whether or not a preset standby time has elapsed after start of heating of the fixing member upon turning on a main body of the image forming apparatus or upon returning from standby state of the main body of the image forming apparatus.

8. The image forming apparatus as claimed in claim 7, wherein the control section controls the opening and closing mechanism so as to switch from the opened state to the closed state only for a preset operating time after the preset standby time has elapsed.

9. An image forming apparatus, comprising:

a fixing member having a cylindrical or annular shape for fixing an image onto a sheet which is in pressure contact with an outer surface thereof;

a heating source for heating the fixing member to a fixing temperature;

a duct which is provided in a position facing the fixing member and which has an inlet for taking in fine particles generated from the fixing member;

an exhaust fan provided inside the duct or in an outlet of the duct for generating an air flow going from the inlet to the outlet of the duct;

a first filter member which is provided upstream or downstream from the exhaust fan inside the duct and which can trap the fine particles which flow through the duct in the air flow;

a control section for controlling an amount of the air flow passing through the first filter member according to initial burst conditions under which the fine particles are emitted from the fixing member;

an outside air introduction port provided upstream from the first filter member with respect to the air flow in the duct; and an opening and closing mechanism capable of switching between an opened state in which air from outside a casing of the image forming apparatus or from a part distant from the fixing member inside the casing is introduced into the duct through the outside air introduction port and a closed state in which the outside air introduction port is blocked, wherein the control section controls the opening and closing mechanism so as to switch between the opened state and the closed state according to the initial burst conditions;

a temperature sensor for measuring temperature of the fixing member, wherein the control section controls the air flow according to the initial burst conditions, depending on whether or not the temperature of the fixing member measured with the temperature sensor has reached a preset threshold temperature;

wherein the control section controls the opening and closing mechanism so as to switch from the opened state to the closed state only for a preset operating time after the temperature of the fixing member measured with the temperature sensor has reached the preset threshold temperature.

10. An image forming apparatus, comprising:

a fixing member having a cylindrical or annular shape for fixing an image onto a sheet which is in pressure contact with an outer surface thereof;

a heating source for heating the fixing member to a fixing temperature;

a duct which is provided in a position facing the fixing member and which has an inlet for taking in fine particles generated from the fixing member;

an exhaust fan provided inside the duct or in an outlet of the duct for generating an air flow going from the inlet to the outlet of the duct;

a first filter member which is provided upstream or downstream from the exhaust fan inside the duct and which can trap the fine particles which flow through the duct in the air flow;

a control section for controlling an amount of the air flow passing through the first filter member according to initial burst conditions under which the fine particles are emitted from the fixing member;

an outside air introduction port provided upstream from the first filter member with respect to the air flow in the duct; and an opening and closing mechanism capable of switching between an opened state in which air from outside a casing of the image forming apparatus or from a part distant from the fixing member inside the casing is introduced into the duct through the outside air introduction port and a closed state in which the outside air introduction port is blocked, wherein the control section controls the opening and closing mechanism so as to switch between the opened state and the closed state according to the initial burst conditions;

an auxiliary duct communicating with the outside air introduction port; and an outside air introduction fan provided inside the auxiliary duct or in an inlet thereof for introducing air from outside of the casing of the image forming apparatus or from a part inside the casing distant from the fixing member into the duct, wherein the control section controls rotation frequency of the outside air introduction fan according to the initial burst conditions.

11. The image forming apparatus as claimed in claim 10, wherein the control section controls the air flow according to the initial burst conditions, depending on whether or not a preset standby time has elapsed after start of heating of the fixing member upon turning on a main body of the image forming apparatus or upon returning from standby state of the main body of the image forming apparatus.

12. The image forming apparatus as claimed in claim 11, wherein the control section decreases rotation frequency of the outside air introduction fan only for a preset operating time after the preset standby time has elapsed as compared with before the preset standby time has elapsed.

13. The image forming apparatus as claimed in claim 10, further comprising:

a temperature sensor for measuring temperature of the fixing member, wherein the control section controls the air flow according to the initial burst conditions, depending on whether or not the temperature of the fixing member measured with the temperature sensor has reached a preset threshold temperature.

14. The image forming apparatus as claimed in claim 13, wherein the control section decreases the rotation frequency of the outside air introduction fan only for a preset operating time after the temperature of the fixing member measured with the temperature sensor has reached the preset threshold temperature as compared with before the temperature of the fixing member measured with the temperature sensor has reached the preset threshold temperature.

* * * * *